US011124349B2

(12) United States Patent
Behafarid et al.

(10) Patent No.: US 11,124,349 B2
(45) Date of Patent: Sep. 21, 2021

(54) SHIPPING SYSTEM FOR SHIPPING GLASS SHEETS

(71) Applicant: Vitro, S.A.B. de C.V., Nuevo León (MX)

(72) Inventors: Farzad Behafarid, Gibsonia, PA (US); Erin A. Casci, Pittsburgh, PA (US); Adam D. Polcyn, Pittsburgh, PA (US); Lewis P. Bevans, Pittsburgh, PA (US)

(73) Assignee: Vitro, S.A.B. de C.V., Nuevo León (MX)

( * ) Notice: Subject to any disclaimer, the term of this patent is extended or adjusted under 35 U.S.C. 154(b) by 274 days.

(21) Appl. No.: 15/712,464

(22) Filed: Sep. 22, 2017

(65) Prior Publication Data

US 2018/0093810 A1 Apr. 5, 2018

Related U.S. Application Data

(60) Provisional application No. 62/402,549, filed on Sep. 30, 2016.

(51) Int. Cl.
*B65D 85/62* (2006.01)
*B65D 85/48* (2006.01)
(Continued)

(52) U.S. Cl.
CPC ..... *B65D 81/113* (2013.01); *B65B 11/48* (2013.01); *B65B 23/20* (2013.01); *B65B 31/048* (2013.01); *B65B 31/06* (2013.01); *B65B 41/16* (2013.01); *B65B 51/16* (2013.01); *B65D 57/00* (2013.01); *B65D 71/063* (2013.01); *B65D 81/051* (2013.01); *B65D 81/107* (2013.01); *B65D 81/2023* (2013.01); *B65D 85/48* (2013.01); *B65D 85/62* (2013.01); *B65D 81/054* (2013.01);
(Continued)

(58) Field of Classification Search
CPC .... B65D 71/06; B65D 71/063; B65D 71/066; B65D 71/08; B65D 71/10; B65D 85/48; B65D 2581/055
USPC ..... 206/454, 448, 453, 497, 597
See application file for complete search history.

(56) References Cited

U.S. PATENT DOCUMENTS 1,913,864 A 6/1933 Walper
1,953,627 A 4/1934 Overholtz
(Continued)

FOREIGN PATENT DOCUMENTS

WO 2007084318 A2 7/2007
WO 2008132853 A1 11/2008

*Primary Examiner* — Steven A. Reynolds
*Assistant Examiner* — Javier A Pagan
(74) *Attorney, Agent, or Firm* — The Webb Law Firm

(57) ABSTRACT

A shipping system for shipping planar substrates includes a plurality of planar substrates stacked to form a pack and a plurality of interleaving material including substantially spherical beads positioned between the substrates of the pack and configured to carry a load. Substantially all of the beads have a diameter within 25% of $D_{max}$, where $D_{max}$ is a diameter corresponding to a size of an opening of an upper limit sieve used in the shipping system. Also disclosed are a spacer for use in a shipping system for shipping planar substrates, a wrapped system for shipping planar substrates, a method of wrapping a system for shipping planar substrates, and a powder applicator.

20 Claims, 28 Drawing Sheets

(51) Int. Cl.

| | |
|---|---|
| ***B65D 81/113*** | (2006.01) |
| ***B65D 81/107*** | (2006.01) |
| ***B65D 81/20*** | (2006.01) |
| ***B65D 57/00*** | (2006.01) |
| ***B65D 71/06*** | (2006.01) |
| ***B65B 31/06*** | (2006.01) |
| ***B65B 51/16*** | (2006.01) |
| ***B65B 41/16*** | (2006.01) |
| ***B65B 31/04*** | (2006.01) |
| ***B65B 11/48*** | (2006.01) |
| ***B65B 23/20*** | (2006.01) |
| ***B65D 81/05*** | (2006.01) |

(52) U.S. Cl.
CPC .. *B65D 2581/053* (2013.01); *B65D 2581/055* (2013.01)

(56) References Cited

U.S. PATENT DOCUMENTS

| | | | | |
|---|---|---|---|---|
| 2,305,405 | A | 12/1942 | Burrell | |
| 3,618,755 | A | 11/1971 | Kean, Sr. et al. | |
| 3,709,358 | A | 1/1973 | Andrews et al. | |
| 3,723,312 | A | 3/1973 | Hay, Jr. | |
| 3,955,676 | A | 5/1976 | Hansen et al. | |
| 4,011,359 | A | 3/1977 | Simpkin et al. | |
| 4,899,880 | A | 2/1990 | Carter | |
| 5,232,962 | A | 8/1993 | Dershem et al. | |
| 5,906,282 | A | 5/1999 | Aldrich et al. | |
| 6,588,605 | B1 | 7/2003 | Volkert et al. | |
| 6,702,118 | B2 * | 3/2004 | O'Connor | B65B 63/04 206/494 |
| 6,752,271 | B2 | 6/2004 | Allison | |
| 6,789,674 | B2 | 9/2004 | Allison | |
| 6,899,946 | B2 | 5/2005 | Geary et al. | |
| 7,210,579 | B2 | 5/2007 | Fujioka et al. | |
| 7,900,775 | B2 * | 3/2011 | Hojholt | B65D 71/0088 206/597 |
| 7,993,741 | B2 | 8/2011 | Hartig et al. | |
| 8,240,473 | B2 | 8/2012 | Van Patten | |
| 8,720,691 | B2 | 5/2014 | Hu | |
| 8,733,548 | B2 | 5/2014 | Kuo et al. | |
| 8,777,008 | B2 | 7/2014 | Hu | |
| 8,807,341 | B2 | 8/2014 | Chan et al. | |
| 8,910,791 | B2 | 12/2014 | Zhao | |
| 9,045,271 | B2 | 6/2015 | Matheison et al. | |
| 9,301,792 | B2 | 4/2016 | Henniges et al. | |
| 9,598,217 | B2 | 3/2017 | Giller | |
| 2002/0005029 | A1 * | 1/2002 | Morris | B65D 85/04 53/461 |
| 2004/0149619 | A1 * | 8/2004 | Dybro | B65D 19/04 206/527 |
| 2005/0194279 | A1 | 9/2005 | Coppola et al. | |
| 2005/0260403 | A1 | 11/2005 | Geary et al. | |
| 2008/0164173 | A1 * | 7/2008 | Savakus | B65D 57/00 206/454 |
| 2009/0057182 | A1 * | 3/2009 | Kamitani | B65D 19/44 206/451 |
| 2010/0000894 | A1 | 1/2010 | Noda et al. | |
| 2010/0155283 | A1 | 6/2010 | Van Patten | |
| 2014/0097115 | A1 | 4/2014 | Kuo et al. | |
| 2015/0298885 | A1 | 10/2015 | Giller | |

* cited by examiner

| | |
|---|---|
| σ | 27 μm |
| μ | 100 μm |
| Total number of beads | 63795 |
| Total bead weight | 45 mg |
| E of glass | 74 Gpa |
| E of PMMA | 3 Gpa |
| ν of glass and PMMA | 0.3 |

| | |
|---|---|
| Glass sizes | 12"x12" |
| Applied force | 160 N |
| Gap between the lites | 142.7 μm |
| Maximum bead compression | 5% |
| Number of beads carrying a load | 2.6% |
| Smallest bead carrying a lod | 143 μm |
| Maximum force on the largest bead | 0.25 N |

$$\delta = \left(\frac{3F}{4E^{*}R^{1/2}}\right)^{2/3} \quad \text{(I)}$$

$$a = \left(\frac{3FR}{4E^{*}}\right)^{1/3} \quad \text{(II)}$$

$$\frac{1}{E^{*}} = \frac{1 - \nu_b^2}{E_b} + \frac{1 - \nu_s^2}{E_s} \quad \text{(III)}$$

$$\delta = \frac{2R - g}{2} \quad \text{(IV)}$$

$$\delta = \left(\frac{3F}{4E^{*}R^{1/2}}\right)^{2/3} = \frac{2R - g}{2} \longrightarrow F(R, g) = \frac{4}{3}E^{*}\left(\frac{2R - g}{2}\right)^{3/2} R^{1/2} \quad \text{(V)}$$

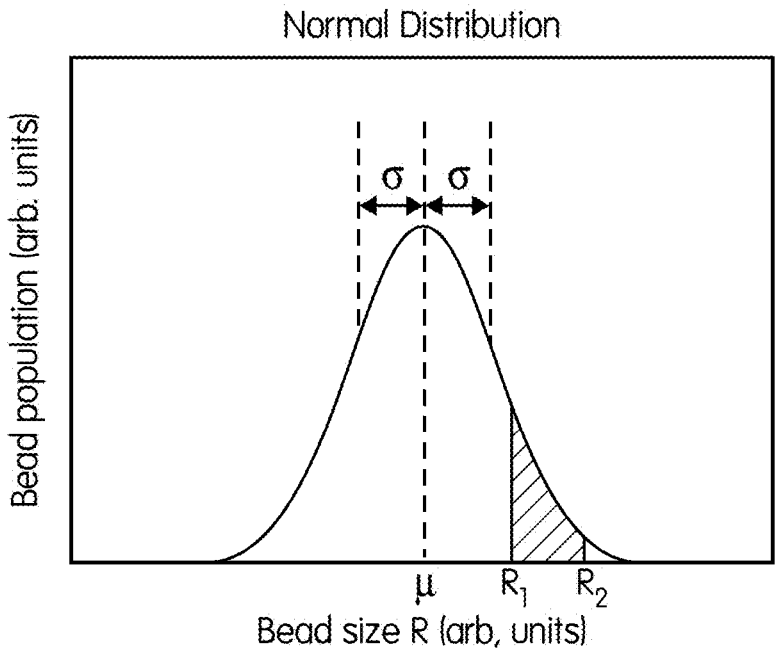

$$n(R) = \left(\frac{N_0}{\sigma\sqrt{2\pi}}\right) e^{\frac{-(R-\mu)^2}{2\sigma^2}} \quad \text{(VI)}$$

$$W_0 = \int_0^{\infty} \rho n(R) \left(\frac{4\pi R^3}{3}\right) dR \quad \text{(VII)}$$

$$\text{Yield } \xi = \frac{\int_{R_1}^{R_2} \rho n(R) R^3 \, dR}{\int_0^{\infty} \rho n(R) R^3 \, dR} \quad \text{(VIII)}$$

$$\text{Total } F(g) = \frac{\sqrt{2}}{3} E^* \int_{R^*}^{R_2} n(R)(2R - g)^{3/2} R^{1/2} dR \quad \text{(IX)}$$

$$R^* = \begin{cases} R_1 & \text{if } R_1 > \frac{g}{2} \\ \frac{g}{2} & \text{if } R_1 < \frac{g}{2} \end{cases} \quad \text{(X)}$$

FIG. 4D

| | |
|---|---|
| σ | 27 µm |
| µ | 100 µm |
| Total number of beads | 23735 |
| Total bead weight | 45 mg |
| E of glass | 74 Gpa |
| E of PMMA | 3 Gpa |
| ν of glass and PMMA | 0.3 |

| | |
|---|---|
| Glass sizes | 12"x12" |
| Applied force | 160 N |
| Gap between the lites | 147.0 µm |
| Maximum bead compression | 2.0% |
| Number of beads carrying a load | 22.2% |
| Smallest bead carrying a lod | 147.5 µm |
| Maximum force on the largest bead | 0.07 N |

SHIPPING SYSTEM FOR SHIPPING GLASS SHEETS

CROSS REFERENCE TO RELATED APPLICATION

This application claims the benefit of U.S. Provisional Application No. 62/402,549, filed Sep. 30, 2016, the disclosure of which is hereby incorporated in its entirety by reference.

BACKGROUND OF THE INVENTION

Field of the Invention

The present invention relates to a shipping system for shipping planar substrates, a spacer for use in the shipping system, a wrapping system for wrapping planar substrates, and a powder applicator.

Description of Related Art

Planar substrates, such as raw sheet glass or glass sheet products, coated with a coating applied by magnetron sputtering vapor deposition (MSVD) or other processes can experience transit damage during shipment from one location to another. This transit damage can be more extensive during shipment of substrates over long distances, such as over 400 miles. An example of damage that can occur over these long shipping distances is "wormtracks" visible on the substrate. Wormtracks are defects with thin (e.g., 100 μm) wiggling patterns. Other examples of transit damage are linear scratch marks and abrasion patterns. These defects may include coating damage, residues left on the substrate by an interleaving material, or both, and may affect the raw substrate or the coated substrate. These defects may affect different regions of the substrate to various extents and, in many cases, may become more apparent after post-transit treatments such as tempering the glass sheet or coating the raw substrate.

The above-described transit damage can lead to the glass sheets being rejected for quality issues. Therefore, it is desirable to develop a shipping system that reduces, or even eliminates, transit damage to the glass sheets.

SUMMARY OF THE INVENTION

The present invention is directed to a shipping system for shipping planar substrates including: a plurality of planar substrates stacked to form a pack; and interleaving material including substantially spherical beads positioned between the substrates of the pack and configured to carry a load. Substantially all of the beads have a diameter within 25% of $D_{max}$, where $D_{max}$ is a diameter corresponding to a size of an opening of an upper limit sieve used in the shipping system.

Substantially all of the beads may have a diameter between 1 μm to 1 mm. Substantially all of the beads may have a radius at or above $D_{min}$ according to the following formula: $D_{min} \geq D_{max}\mu^2$, where $D_{max}$ is a diameter corresponding to a size of an opening of an upper limit sieve used in the shipping system and μ is a friction coefficient between the beads and the substrate. Substantially all of the beads may have a diameter within 10% of $D_{max}$. The shipping system may include plurality of packs, each of the packs comprising an exposed face, and the shipping system further may include a spacer positioned between two of the packs. The spacer may include an area in contact with the exposed faces of the packs. The spacer may include polystyrene. The spacer may have a continuous thickness in the area in contact with the exposed faces of the packs, and the area covers substantially an entire area of the exposed faces of the packs in contact with the spacer.

The packs and substrates may include a first region, a second region, and a third region between the first region and second region, and the spacer may be in contact with the exposed faces of the first regions and/or second regions of the packs. The first regions and second regions of the packs and substrates may range from 1% to 10% of the length, as measured from a first edge and second edge of the packs and substrates, respectively. The spacer may include a first raised area in contact with the exposed faces of the first regions of the packs and a second raised area in contact with the exposed faces of the second regions of the packs. The first raised area and second raised area may include a softer material compared to a material of the spacer. The spacer may include a elongated portion running between the first raised area and second raised area, and the elongated portion may not be in contact with the exposed faces of the packs.

The shipping system may further include an A-frame configured to support the packs. The A-frame may include a strut, the strut in contact with the exposed face of one of the packs. The strut may include a plurality of raised regions, the raised regions including a softer material compared to a material of the strut, where the raised regions may include a first raised region and a second raised region, and where the first raised region may be in contact with the exposed face of the first region of the pack in contact with the strut and the second raised region may be in contact with the exposed face of the second region of the pack in contact with the strut. An interleaving material coverage between two of the substrates of one of the packs may be 2 to 20 times greater between the first and/or second regions of the substrates compared to an interleaving material coverage of the interleaving material between the third regions of the substrates. Each of the packs may be wrapped in a sealed plastic wrap. The interleaving beads may include poly(ethyl methacrylate) (PEMA) or poly(methyl methacrylate) (PMMA) beads.

The present invention is also directed to a shipping system for shipping planar substrates including: a plurality of planar substrates stacked to form a pack; and interleaving material comprising substantially spherical beads positioned between the substrates of the pack and configured to carry a load. Substantially all of the beads may have a radius at or above $D_{min}$ according to the following formula: $D_{min} \geq D_{max}\mu^2$, where $D_{max}$ is a diameter corresponding to a size of an opening of an upper limit sieve used in the shipping system and μ is a friction coefficient between the beads and the substrate. In some non-limiting embodiments, substantially all of the beads may have a diameter within 25% of $D_{max}$, where $D_{max}$ is a diameter corresponding to a size of an opening of an upper limit sieve used in the shipping system.

The present invention is also directed to a spacer for use in a shipping system for shipping planar substrates including: an elongated portion having a first end and a second end and a first side and a second side; a flange positioned at the first end of the elongated portion and extending from the first side; and a raised area positioned on the elongated portion.

The spacer may include polystyrene. The raised area may include a softer material compared to the elongated portion. The softer material may include polyethylene or polyurethane. The raised area may be at least ⅛ inch thick. The spacer may include a plurality of raised areas positioned on the elongated portion. The plurality of raised areas may include a first raised area and a second raised area. The first raised area may be positioned on the first side of the first end of the elongated portion and the second raised area may be positioned on the first side of the second end of the elongated portion. The plurality of raised areas may include a first raised area and a second raised area. The first raised area may be positioned on the first side of the first end of the elongated portion and the second raised area may be positioned on the second side of the first end of the elongated portion. The second raised area may extend over a corner of the first end of the elongated portion. The second side of the elongated portion may not comprise the raised area.

The spacer may further include tape covering the raised area. The first end of the elongated portion may include a first width and the second end of the elongated portion may include a second width, where the first width may be larger than the second width. The first end and the second end of the elongated portion may include a first width, and a section of the elongated portion between the first end and the second end may include a second width, where the first width may be larger than the second width. The spacer may be positioned between a plurality of packs in the shipping system, each pack having a plurality of planar substrates. The flange may be positioned over a top of a pack and the elongated portion may be positioned over an exposed face of the pack. The raised area may be in contact with the exposed face of the pack. The raised area may be in contact with an end of the exposed face of the pack. The end of the exposed face of the pack may include a region at the end of the pack having a length of 1% to 10% of the length of the pack, as measured from an edge of the pack. A plurality of the spacers may be positioned between the plurality of packs. A single spacer may be positioned between the plurality of packs, the single spacer having a width substantially the same as a width of the plurality of packs.

The present invention is also directed to a wrapped system for shipping planar substrates including: a plurality of planar substrates stacked to form a pack and plastic wrap positioned around the pack. The plastic wrap is sealed around the pack.

The plastic wrap may be sealed such that moisture is prevented from reaching the pack. The seal may be formed by thermal sealing. Air may be removed from the wrapped system prior to completely sealing the plastic wrap. Removal of the air may create a vacuum in the wrapped system. The plastic wrap may include polyethylene. The plastic wrap may be corrugated. The plastic wrap may include a single sheet. The wrapped system may be free of openings in the plastic wrap. The planar substrates may include glass.

The present invention is also directed to a method of wrapping a system for shipping planar substrates including: providing a plurality of planar substrates stacked to form a pack; positioning plastic wrap to completely surround the pack; and sealing at least a portion of the plastic wrap.

The plastic wrap may be sealed such that moisture is prevented from reaching the pack. The sealing step may include thermally sealing the plastic wrap. The method may include removing air from the system before completely sealing the plastic wrap. The plastic wrap may include polyethylene. The plastic wrap may include a single sheet. The system may be free of openings in the plastic wrap. The plastic wrap may be corrugated. Removing air from the system may create a vacuum in the system. The planar substrates may include glass.

The present invention is also directed to a powder applicator including: a bucket configured to hold powder; a tubing including a proximal end and a distal end, the tubing in fluid communication with the bucket and configured to allow powder to flow therethrough; and a vibrator including a motor. The vibrator co-acts with the tubing so as to vibrate the tubing when the vibrator is activated. The tubing includes a substantially horizontal portion proximate the distal end of the tubing such that, when the vibrator is not activated, the powder in the tubing does not exit the distal end of the tubing and, when the vibrator is activated, the powder in the tubing exits the distal end of the tubing.

The applicator may include a charge applicator. The charge applicator may co-act with the tubing such that, when activated, the charge applicator applies a charge to the powder flowing through the tubing. The applicator may further include a plastic tube ending in fluid communication with the distal end of the tubing. When the vibrator is activated, the powder in the tubing may exit the distal end of the tubing creating a powder shower. The powder shower may be substantially conical in shape. When the vibrator is activated, the powder may substantially uniformly coat a substrate passing under the powder applicator over an entire region of the substrate spanned by the powder shower.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 4D shows equations relating the force between the substrates as a function of a gap between the substrates;

DESCRIPTION OF THE INVENTION

Figure 1:
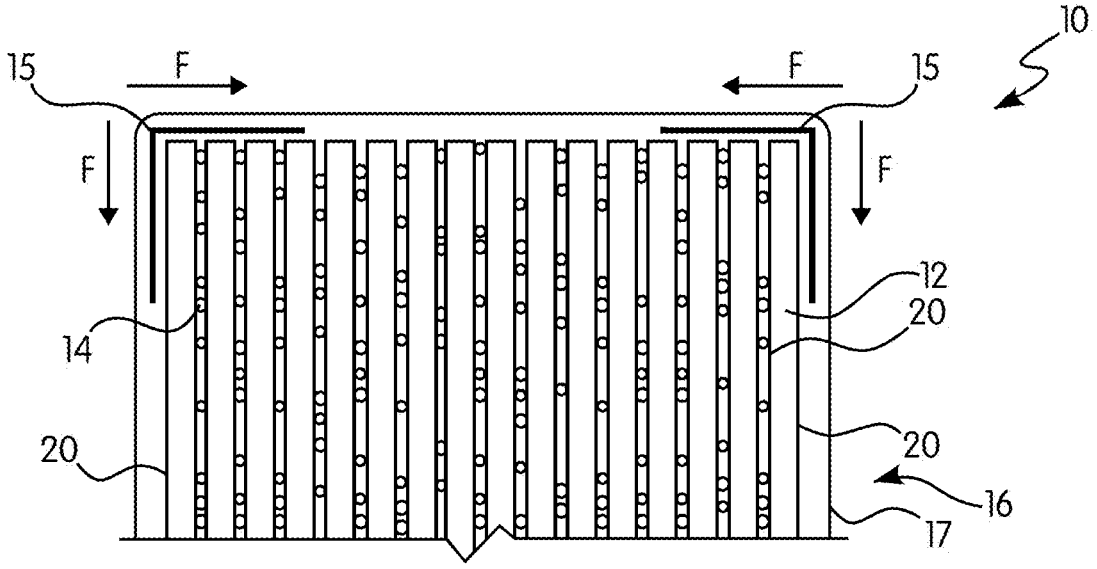
FIG. 1 is a schematic view of an exemplary shipping system according to the present invention.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

For purposes of the following detailed description, it is to be understood that the invention may assume various alternative variations and step sequences, except where expressly specified to the contrary. Moreover, other than in any operating examples, or where otherwise indicated, all numbers used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

I. Shipping System

Referring to FIG. 1, a shipping system 10 for shipping planar substrates 12, such as glass sheets 12, includes a plurality of the substrates 12 stacked against each other, with interleaving material 14 in between the substrates 12 to form a pack 16. The pack 16 includes edge protectors 15 to help hold the pack 16 together. The edge protectors 15 may be made of any packing material, such as cardboard or plastic (for example, Styrofoam). The pack 16 may be wrapped by a wrap 17 for safety reasons, to further hold the pack 16 together, or for protection against environment. The wrap 17 may be made of any suitable materials, such as plastic wrap. The wrap 17 may exert a force (F) on the pack 16, as shown in FIG. 1.

The substrates 12 in the shipping system 10 may be either coated or uncoated substrates. It is also contemplated that the substrates 12 of the shipping system 10 are made of any material that is scratchable, like coated glass, or any other substrate that may be considered defective due to residues left on the surface by interleaving material 14, such as metal sheets or raw glass. The substrates 12 may have a temporary protective overcoat (TPO) coating on their surface. The interleaving material 14 may be made of polymeric materials, organic materials, metallic materials, ceramic materials, or a combination of both. Examples of interleaving material may be poly(ethyl methacrylate) (PEMA), poly (methyl methacrylate) (PMMA), polycarbonate, polyethylene, wood flour, paper sheets, or polymeric protective sheets. The interleaving material 14 used in the shipping system 10 may be made of any material suitable for carrying a load. In one example, the interleaving material 14 may be interleaving beads 14 used for coated glass shipment made of PMMA or PEMA that are substantially spherical in shape. "Substantially spherical" means that the interleaving beads 14 may be perfectly spherical or that a length of any radius from a mass center of the interleaving bead 14 to an end of the interleaving bead 14 is within 5%, such as 2%, 1%, 0.5%, 0.25%, or 0.1% of a length of any other radius measured from the mass center to any other end of the interleaving bead 14. The interleaving beads 14 may be micron-sized interleaving beads 14. Micron-sized means having a diameter between 1 μm and 999 μm. Substantially all of the interleaving beads 14 in the shipping system 10 may have a diameter ranging from 1 μm to 1 mm, such as 50 μm to 500 μm, such as from 100 μm to 250 μm, such as 150 μm to 200 μm, such as from 100 μm to 200 μm. In this context, "substantially all" means at least 75%, such as at least 80%, at least 85%, at least 90%, at least 95%, or 100%. The size of the interleaving beads 14 can be selected based on the interleaving bead material, the forces that are applied to interleaving beads 14, bead retention requirements, minimizing the moisture accumulation due to capillary forces, the material of the substrates 12, a coating applied to the substrates 12, or any other material or process in the shipping system 10 that may be affected by the size of the interleaving beads 14. The size of the interleaving beads 14 may also be selected based on the capabilities of commercially available sieves; however, in some embodiments, custom sieves may be used to yield interleaving beads 14 within a custom size range and distribution. The interleaving material 14 may not be substantially spherical as well, such as in sheets, powders, or flakes.

The packs 16 may include a plurality of the substrates 12 having the interleaving material 14 between each of the substrates 12 in the packs 16. The packs 16 may include only 2 substrates 12 or the packs 16 may have any number of substrates 12. For example, the packs 16 can have between 2 and 20 substrates 12, such as 2, 4, 6, 8, 10, 12, 14, 16, or 18 substrates 12. The packs 16 may include over 20 substrates 12. The substrates 12 of the packs 16 may be stacked on top of each other, with the interleaving material 14 in between adjacent faces of the substrates 12. The substrates 12 may be stacked with their edges against the ground, as opposed to the face of the substrate 12 against the ground. In some embodiments, the substrates 12 are coated, uncoated, or a combination thereof. The coated surfaces of the substrates 12 may be stacked, against another coated surface (coating-to-coating), against an uncoated surface (coating-to-uncoated surface), or a mixture thereof. The pack 16 may include edge protectors 15 at the edges and corners of the packs 16 to aid in holding the substrates 12, to cover the sharp edges of the glass, and for safety reasons. The packs 16 of the substrates 12 may be put together at the manufacturing plant and, once the substrates 12 are arranged in the packs 16, the packs 16 may be shipped.

Figure 2:
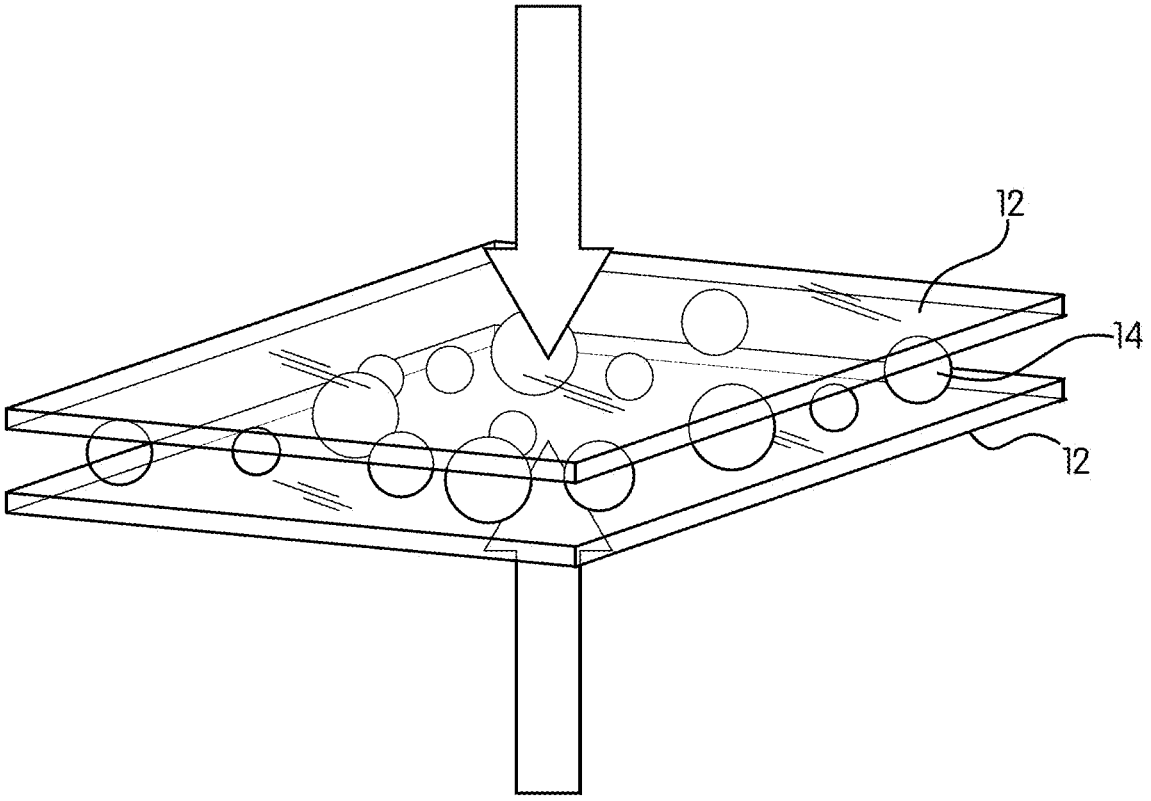
FIG. 2 is a schematic view of interleaving material in the form of spherical interleaving beads between substrates.
Figure 3:
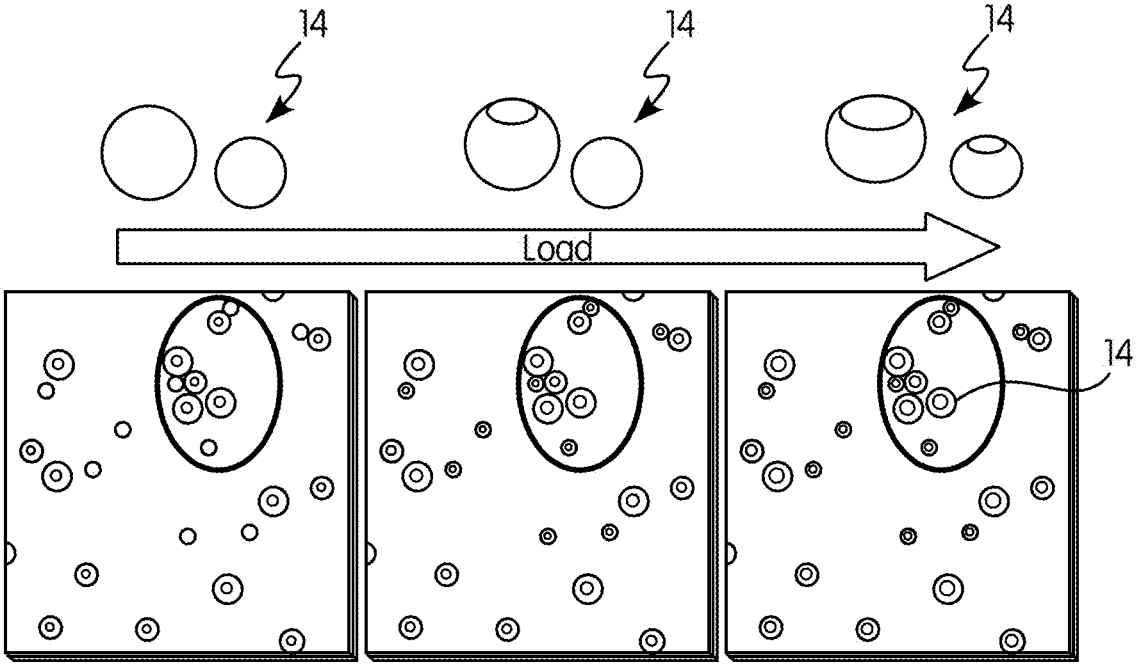
FIG. 3 is a series of micrographs showing the effect of increased load on the spherical interleaving beads.

Referring to FIGS. 2 and 3, the interleaving material 14 may be positioned between the substrates 12 to prevent the adjacent substrates 12 from coming into contact during shipment. The interleaving material 14 positioned between the substrates 12 may be configured to support a load. The load may be created, at least in part, by the weight of the substrates 12, holding straps or other mechanisms devised to confine the pack 16, dynamic forces created in transit, or any combination of the above. As shown in FIG. 2, the load may be a compressive force on the interleaving beads 14 exerted by the substrates 12 or any other outside force in addition to the substrates 12 (e.g., dynamic vibrational forces, A-frame or other packaging arrangement, the force from non-adjacent substrates 12 or other packs 16 simultaneously being shipped). FIG. 3 shows the effect of the load on the interleaving beads 14 as the load is increased. In the first micrograph on the far left frame of FIG. 3, a comparatively low load is placed on the interleaving beads 14. Moving to the middle and right micrographs in FIG. 3, the load on the interleaving beads 14 is increased. As the load on the interleaving beads 14 is increased, the interleaving beads 14 deform, and the larger the size of the interleaving beads 14, the greater the deformation. The force distribution among the plurality of interleaving beads 14 is not uniform and interleaving beads 14 with sizes smaller than a certain limit may not carry any load, while a small portion of larger interleaving beads 14 might carry the entire load. In certain conditions, when the load is excessive, the largest interleaving beads 14 carrying the highest portion of the load may break under the load. At this point, the load would fall on slightly smaller interleaving beads 14 that may also break and shift the load to even smaller interleaving beads 14. Such broken pieces of interleaving beads 14 may be associated with mechanical abrasion and linear defect marks on the substrate 12, both in the form of mechanical damage to the substrate 12 or residues contaminating the substrate 12. In other cases, the applied forces may permanently deform the interleaving beads 14 due to forces that result in the interleaving beads 14 reaching the yield stress internally or due to a time dependent creep, but the interleaving beads 14 do not necessarily crack at the surface or lose their mechanical integrity. These phenomena may be caused by shipping long distances, under gentle pounding of low intensity vibrations, or for packages stored for an extended time under a static pressure. The deformed interleaving beads 14 may no longer be substantially spherical, which makes it more difficult or, in some cases, impossible for the interleaving beads 14 to roll. In some cases, the permanently deformed interleaving beads 14 may be an ellipsoid shape. The inability of the deformed interleaving beads 14 to roll leads to the interleaving beads 14 rubbing against the surface for extended periods of time. This may lead to a phenomenon commonly referred to as wormtracking. Wormtracks are thin (e.g., 100 μm) wiggling patterns of defects on the coating, and these damages may extend through the coating and onto the face of the substrate as well. Therefore, damage may be effected by the above-described types of failure of the interleaving beads 14, which lead to (i) wearing down the top layers of the coating of the substrate 12; (ii) shearing the coating through the layers with the weakest adhesion; or (iii) leaving polymeric residues on the substrate 12. In one embodiment of the present shipping system 10, an interleaving bead 14 coverage is provided such that substantially all of the interleaving beads 14 in the shipping system 10 do not fail while carrying the load, as described above. In this context, "substantially all" means at least 75%, such as at least 80%, at least 85%, at least 90%, at least 95%, or 100%.

A. Preventing Shipping Damage Via Improved Bead Size Distribution

Figures 4A, 4B:
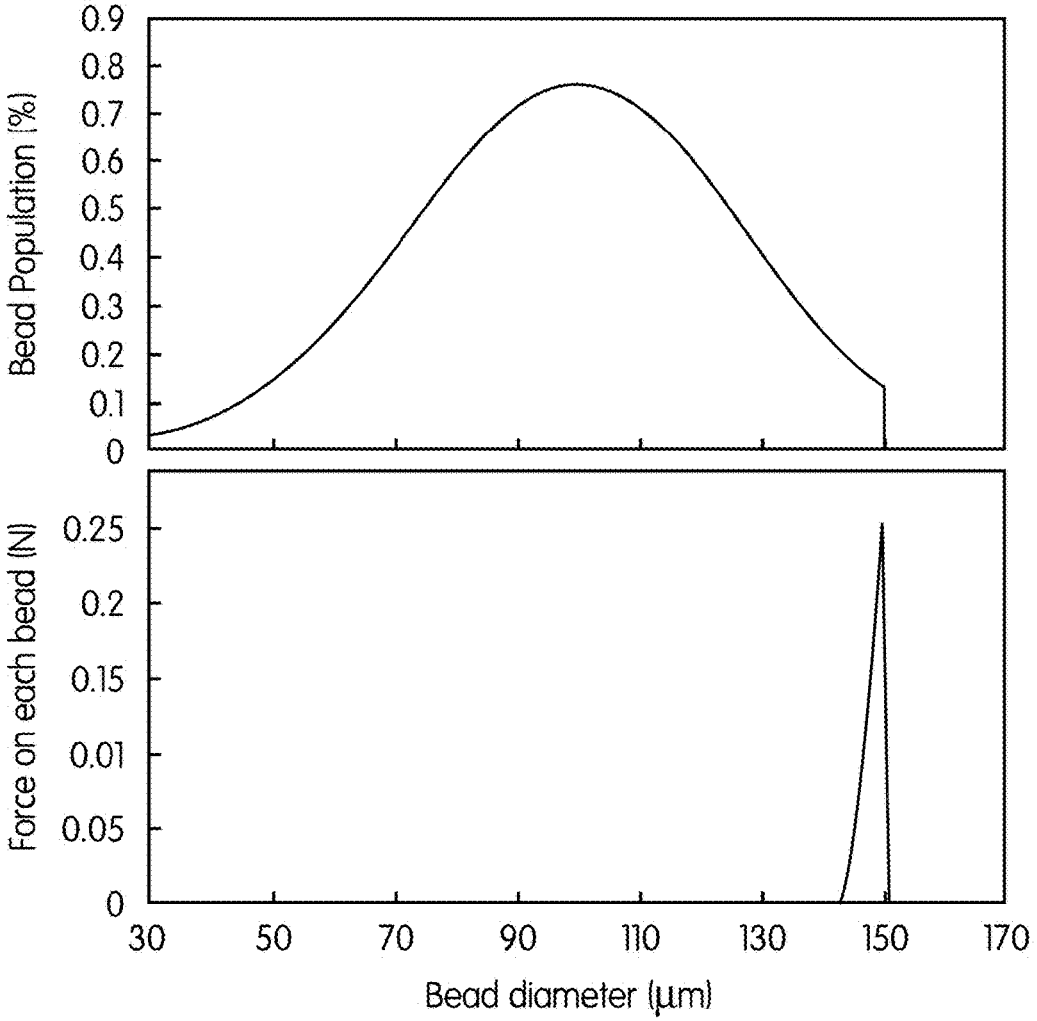
FIG. 4A is a graph showing a normal bead distribution of interleaving beads and force on each interleaving bead for each interleaving bead diameter used in prior art shipping systems.
FIG. 4B is a table showing a percentage of the interleaving beads of a prior art shipping system carrying a load.

Referring to FIGS. 4A and 4B, the above-described failure, such as permanent deformation of the interleaving beads 14 in the shipping system 10, may correlate with bead size distribution of the interleaving beads 14. Interleaving beads 14, such as interleaving beads 14 made of poly(ethyl methacrylate) (PEMA) or poly(methyl methacrylate) (PMMA), such as Lucor beads, are commonly manufactured having a varying bead size distribution. An exemplary bead size distribution and force on each interleaving bead 14 is shown in FIG. 4A. The bead size distribution shown in FIG. 4A follows a substantially normal distribution initially having interleaving beads 14 that range from less than 30 μm to greater than 150 μm. However, the beads were sieved using a 150 μm sieve so that substantially all of the interleaving beads 14 larger than 150 μm were removed. In this context, "substantially all" means at least 75%, such as at least 80%, at least 85%, at least 90%, at least 95%, or 100%. With such a bead size distribution being used, only a small percentage of the interleaving beads 14 carried the load, since the smaller diameter interleaving beads 14 that are not in contact with both substrates 12 do not participate in supporting the load. The stress distribution and the interleaving bead deformation may be calculated theoretically using Hertzian equations. The related equations are provided in FIG. 4D. Following these equations, the interleaving bead deformation may be calculated as a function of the force applied on that interleaving bead 14. For a plurality of interleaving beads 14 between the two substrates 12, the gap between the substrates 12 becomes a common parameter for all interleaving bead 14 sizes. Therefore, for a plurality of interleaving beads 14, confined to the same gap between the substrates 12, the force between the substrates 12 may be obtained as a function of the gap and vice versa (see FIG. 4D). Any interleaving bead 14 smaller than the gap between the substrates 12 does not carry any load.

FIG. 4B shows one example of test results from using interleaving beads 14 having the bead size distribution of FIG. 4A. In FIG. 4B, E represents the elastic modulus, μ represents mean bead size, σ represents standard deviation, and v represents the Poisson's ratio. In this example, an interleaving bead coverage of 45 mg/ft$^2$ is used. Under a hypothetical load of 160 N, the gap between the substrates 12 becomes approximately 143 μm, meaning the smallest interleaving bead 14 carrying the load is approximately 143 μm. Therefore, only about 2.6% of the interleaving beads 14 in the shipping system 10 are carrying the load, and the maximum interleaving bead deformation is about 5% in this example.

The number of interleaving beads 14 carrying the load may be increased as much as needed so that they do not fail (as described previously) under the mechanical loads they would experience in shipping and storage. The required interleaving bead coverage may be estimated following the equations provided in FIG. 4C if a good estimation of the mentioned loads and the interleaving beads 14 properties are available, otherwise the adequate interleaving bead coverage may be estimated through experimental results obtained from actual shipping trials or smaller scale simulated transit setups. To achieve a larger number of participating interleaving beads 14, the overall interleaving bead coverage may be increased. However, in many cases, there are different factors limiting the interleaving bead coverage, including but not limited to environmental issues with interleaving beads 14 in the waste stream, safety issues with slippery surfaces due to fallen interleaving beads 14, process issues with proper and uniform application of high interleaving bead coverage, and other process issues such as handling the substrate by suction cups. Therefore, it may be desirable in some cases to achieve an adequate number of load bearing interleaving beads 14 without increasing the overall coverage beyond the limitation dictated by the process.

Figure 5:
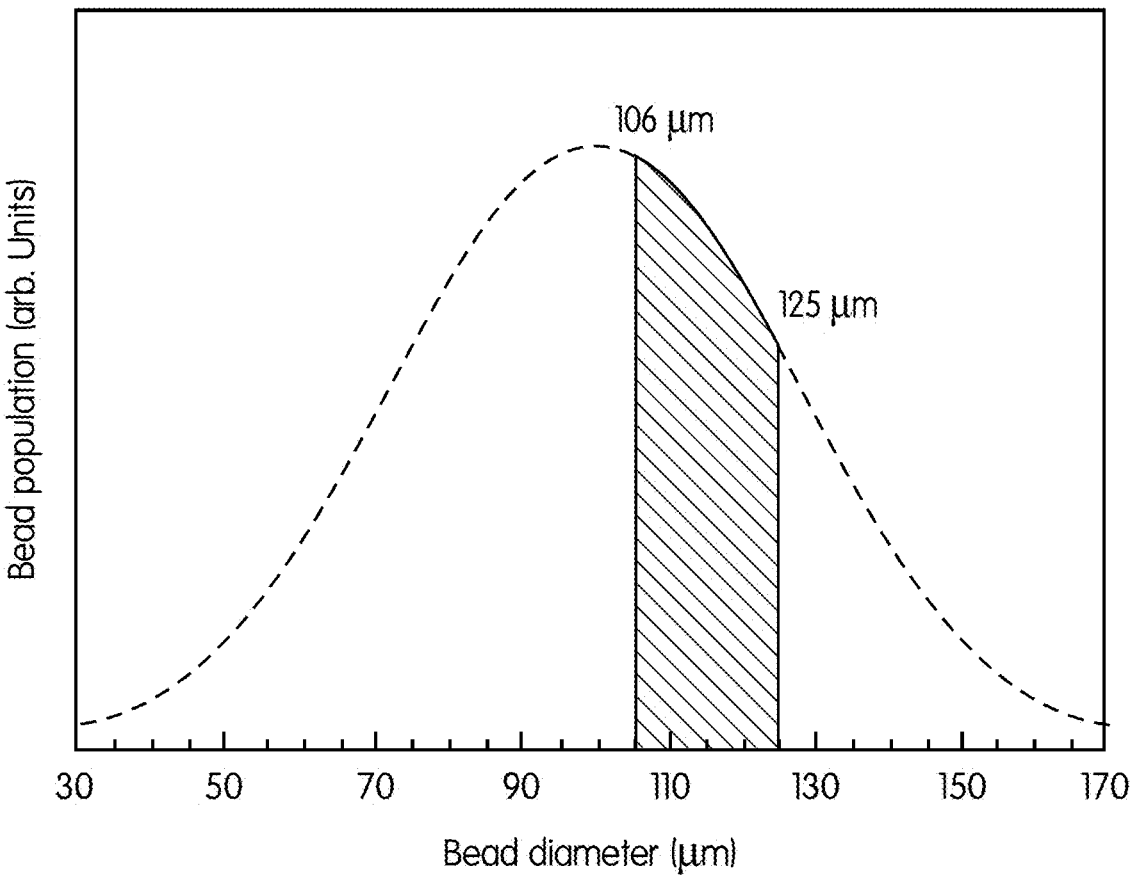
FIG. 5 is a graph showing a middle pass sieve of interleaving beads used in one example of the present invention.
Figure 6:
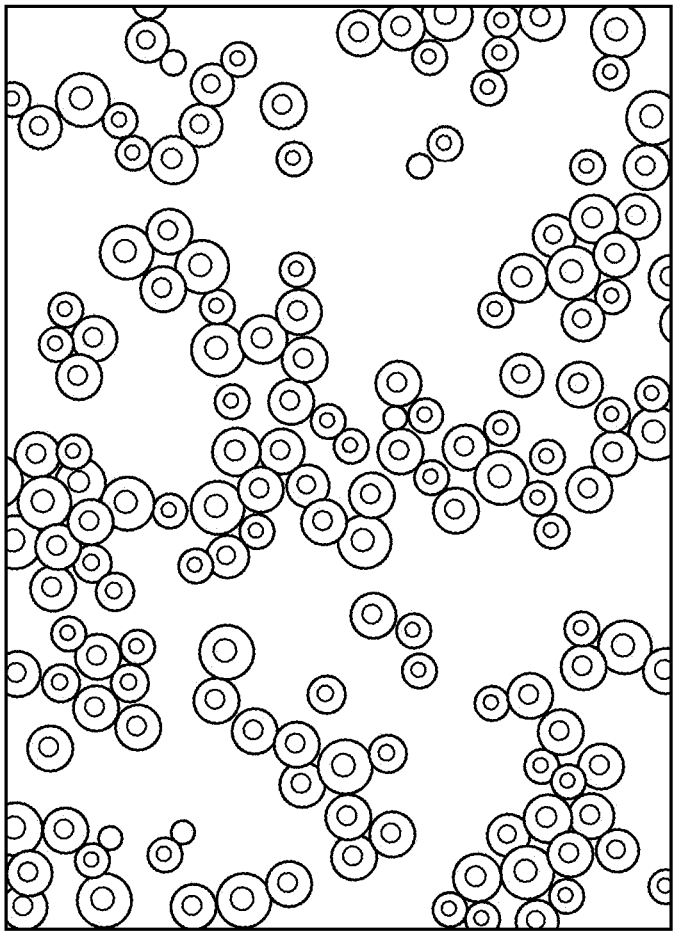
FIG. 6 is a micrograph showing the interleaving beads used in an exemplary bead size distribution according to the present invention.
Figure 7:
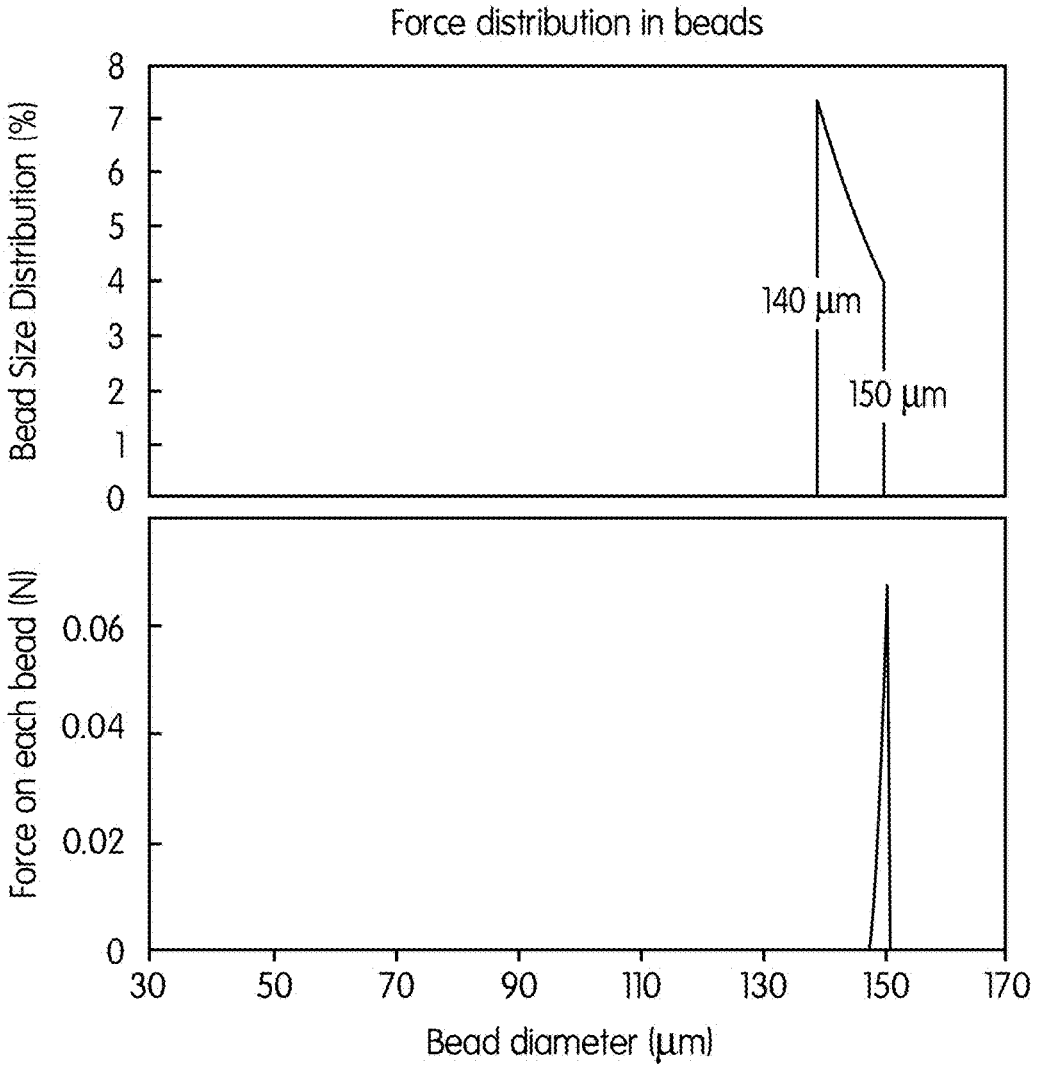
FIG. 7 is a graph showing a middle pass sieve of interleaving beads used in another example of the present invention where over 20% of the interleaving beads in the shipping system carry the load.

Referring to FIGS. 5-7, a middle pass sieving may be performed on the interleaving beads 14 having the bead size distribution shown in FIG. 4A. A middle pass sieving narrows the bead size distribution and maximizes the percentage of the largest interleaving beads 14 in the distribution in the shipping system 10 so that the largest interleaving beads 14 and smallest interleaving beads 14 from FIG. 4A are removed, and these removed interleaving beads 14 may be used for other purposes or may be further sieved to create other favorable bead size distributions. The middle pass sieving may be performed to maximize the number of the largest interleaving beads 14 in the distribution, as opposed to merely tightening the size distribution with a narrower normal distribution. The remaining interleaving beads 14 may make it so that substantially all of the interleaving beads 14 fall into the intended narrower bead size distribution for use in the shipping system 10. In this context, "substantially all" means at least 75%, such as at least 80%, at least 85%, at least 90%, at least 95%, or 100%.

In the example shown in FIGS. 5 and 6, the middle pass sieving results in substantially all of the interleaving beads 14 in the range of 106-125 μm being used. In this context, "substantially all" means at least 75%, such as at least 80%, at least 85%, at least 90%, at least 95%, or 100%. This range of interleaving beads 14 may be isolated by first sieving out the large interleaving beads 14 using a sieve that retains beads having a diameter over 125 μm, so that only interleaving beads 14 having a diameter of 125 μm or smaller remain. Then the remaining interleaving beads 14 may be sieved using a sieve that only allows beads having a diameter smaller than 106 μm to pass through, so that what remains are interleaving beads 14 having a diameter ranging from 106-125 μm. While this one example of sieving the interleaving beads 14 to the desired range has been described, any suitable method for isolating the desired range of interleaving beads 14 may be used, such as first sieving away the smaller interleaving beads 14, followed by then sieving away the larger interleaving beads 14, or entirely different methods such as centrifugal based setups. FIG. 6 shows a micrograph of the interleaving beads 14 having the narrower bead size distribution of 106-125 μm.

It is to be appreciated that any range of bead size distribution of the interleaving beads 14 may be used. It may be desirable to narrow the bead size distribution such that more interleaving beads 14 are helping to support the load during shipping (more of the larger interleaving beads 14 remain in the bead size distribution). It may be desirable to have a sharp cutoff (high large negative first derivative) to the bead size distribution near the high end of the interleaving bead size. In one example, all of the interleaving beads 14 are of the exact same size so that all of the interleaving beads 14 contribute to support the load. In some examples, between any two substrates 12, at least 15%, such as at least 20%, 25%, 30%, 35%, 40%, 45%, 50%, 60%, 70%, 80%, 90%, or 100% support the load.

Further, in some examples, the diameter of substantially all of the interleaving beads 14 made of PEMA or PMMA (or any other polymeric material having an appropriate Young's modulus) in the bead size distribution ranges from 90 μm to 150 μm, such as 106 μm to 125 μm, 109 μm to 117 μm, 135 μm to 150 μm, 140 μm 150 μm, or any range therebetween. In this context, "substantially all" means at least 75%, such as at least 80%, at least 85%, at least 90%, at least 95%, or 100%. In some embodiments, the interleaving beads 14 in this range do not follow a substantially normal distribution but include a larger percentage of the larger sized interleaving beads 14 in the interleaving beads 14 used compared to a substantially normal bead size distribution. In some embodiments, substantially all of the interleaving beads 14 have a diameter within 5% of $D_{max}$, where $D_{max}$ is a diameter corresponding to a size of an opening of an upper limit sieve used in the shipping system. In some embodiments, substantially all of the interleaving beads 14 have a diameter within 10% of $D_{max}$. In some embodiments, substantially all of the interleaving beads 14 have a diameter within 25% of $D_{max}$. In this context, "substantially all" means at least 75%, such as at least 80%, at least 85%, at least 90%, at least 95%, or 100%. Thus, theoretically, $D_{max}$ should be the diameter of the largest bead in the shipping system.

Figure 4C:
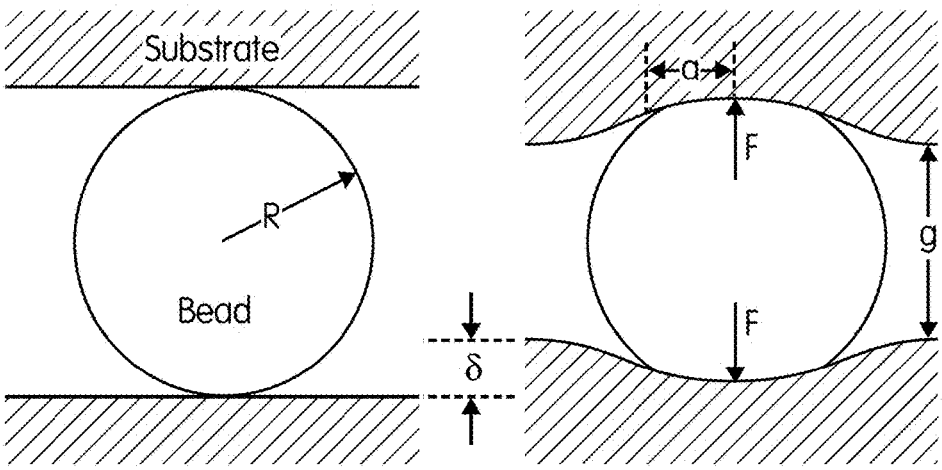
FIG. 4C shows equations relating interleaving bead deformation as a function of applied force.

As shown in FIG. 4C, the bead deformation (6) may be a function of applied force (F), applied by the interleaving bead 14 on substrate 12 materials. The time period that the force may be applied if creep is significant. Equation I of FIG. 4C shows the equation to calculate bead deformation (δ), where E* is the equivalent elastic modulus and R is the radius of the undeformed interleaving bead 14. According to Equation II of FIG. 4C, the radius of contact area (a) may be calculated and is a function of F, R, and E*. E* may be calculated using Equation III of FIG. 4C, in which $E_b$ and $E_s$ are the elastic moduli and $v_b$ and $v_s$ are the Poisson's ratios associated with the bead 14 and the substrate 12, respectively. According to Equation IV of FIG. 4C, bead deformation may also be calculated as a function of the gap (g) between the two substrates. As a result of Equations I-IV of FIG. 4C, the applied force (F) may be calculated as a function of R and g based on Equation V of FIG. 4C.

Considering the equations in FIG. 4C, to obtain a desired bead size distribution, an estimate may be needed to determine how much interleaving bead deformation would be excessive. An excessive interleaving bead deformation may be one resulting in (i) interleaving bead 14 breakage, (ii) a permanent deformation of the interleaving bead 14 to an extent hindering or preventing the bead rolling, and (iii) an increase in friction and shear forces induced at the bead-substrate contact area (all examples of interleaving bead 14 failure). The amount of interleaving bead deformation that may considered as excessive may be defined in a case-by-case approach considering the material properties and process characteristics. In one embodiment, the maximum deformation ($\delta_{max}$) may be less than 5%. In another embodiment, using a softer interleaving bead 14, the maximum deformation ($\delta_{max}$) may be less than 10%. Therefore, to prevent substrate 12 damages induced by interleaving beads 14, interleaving bead deformation may not exceed $\delta_{max}$ in some cases. Subsequently, it follows that any interleaving bead 14 smaller than $(1-\delta_{max})\times D_{max}$ would not participate in sharing the load between the substrates 12 and, therefore, may be removed from the interleaving bead 14 population without any adverse effect. In other words, in any bead size distribution, one may consider the size range between $(1-\delta_{max})\times D_{max}$ and $D_{max}$ as the only part of population that carries any load, and if the beads smaller than $(1-\delta_{max})\times D_{max}$ are not removed from the population, they may not be considered when the interleaving bead coverage is being optimized or compared with other possible size distributions in terms of performance.

Referring to FIG. 4D, a graph shows a normal distribution of bead size R of a interleaving bead 14 population. A normalized distribution for bead size n(R) is shown mathematically by Equation VI of FIG. 4D. In Equation VI, $N_o$ is the total number of beads, δ is the standard deviation, and μ is the mean bead size. To total bead weight ($W_0$) may be calculated based on Equation VII of FIG. 4D where p is density of the bead material. The weight yield (ξ) to separate a tighter size range between $R_1$ and $R_2$ (through sieving methods of other methods) may be calculated based on Equation VIII of FIG. 4D. Following the Hertzian contact theory, the total force (F) carried out by this bead size population may be calculated as a function of the gap (g) between the substrates according to Equation IX of FIG. 4D, where R* is the smallest bead size that carries any load. If the gap is smaller than the smallest bead, then all the beads carry the load. If the gap is bigger than the smallest bead, only the beads having a diameter equal or larger than the gap would carry the load. Therefore, R* would be equal to one of the equations in Equation X of FIG. 4D based on the relative values of $R_1$ and (g/2).

FIG. 7 illustrates an example of a result of the narrower bead size distribution of the interleaving beads 14 in the shipping system 10. FIG. 7 also shows the force on each interleaving bead 14 having a certain diameter. In this example, 50 substrates 12 were used with interleaving beads 14 in between. The interleaving beads 14 having an initial bead distribution of FIG. 4A were sieved to result in substantially all of the interleaving beads 14 falling in the range of 140 μm to 150 μm. In this context, "substantially all" means at least 75%, such as at least 80%, at least 85%, at least 90%, at least 95%, or 100%. In this example, the gap between the substrates 12 was 147 μm, meaning the smallest interleaving bead 14 contributing to supporting the load was also 147 μm. This resulted in approximately 22.2% of the interleaving beads 14 supporting the load, and the deformation (δ) to be limited to about 2%.

Figure 8A:
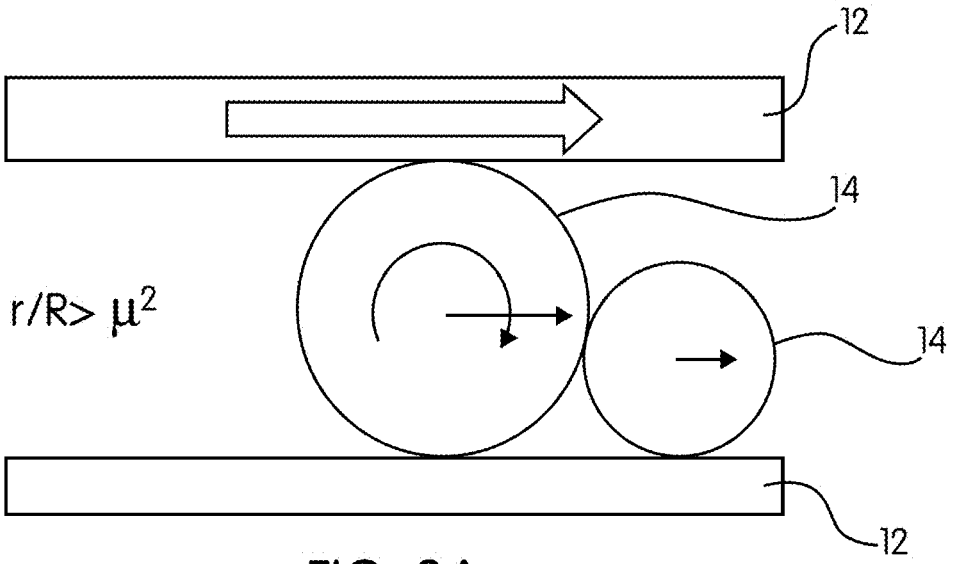
FIG. 8A is a schematic view of interleaving beads according to an example of the present invention such that the smaller interleaving beads are large enough to be pushed out of the way by the larger interleaving beads.
Figure 8B:
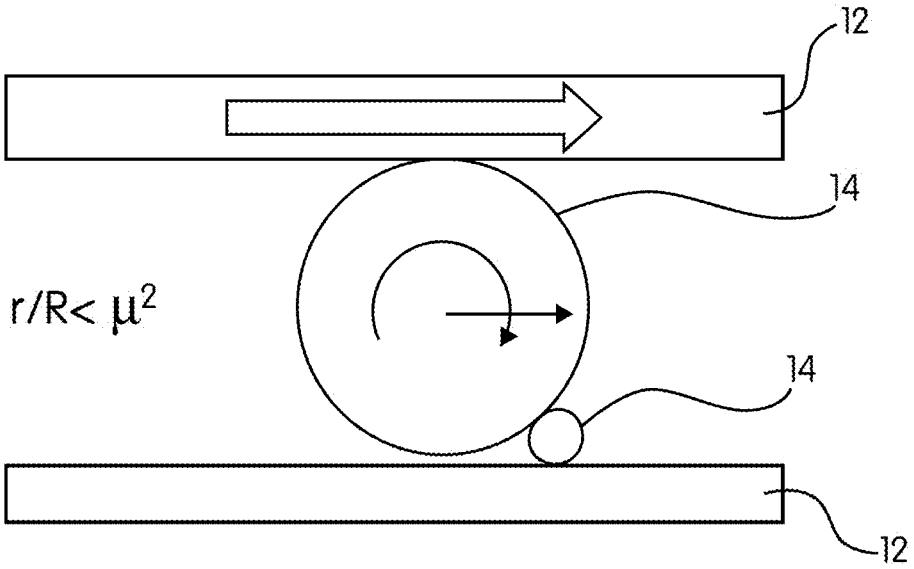
FIG. 8B (Prior Art)
FIG. 8B is a schematic view of interleaving beads in a prior art shipping system having smaller interleaving beads that are too small to be pushed away by the larger beads but are instead wedged or locked under the larger interleaving beads.

As previously discussed, the interleaving beads 14 smaller than the gap between the substrates 12 do not participate in load sharing. The very small interleaving beads 14 not participating in load sharing may actually cause defects if the bead-bead interactions are probable. Referring to FIGS. 8A and 8B, the relative size of the largest and smallest interleaving bead 14 may be controlled in the shipping system 10 to prevent damage to the substrates 12 in transit. FIG. 8A shows the interaction of the larger and smaller interleaving beads 14 in one example of the shipping system 10 according to the present invention. When the smaller interleaving bead 14 encounters a larger interleaving bead 14, the smaller interleaving bead 14 may be pushed out of the way by rolling away. If the smaller interleaving bead 14 is too small relative to the larger interleaving bead 14, the smaller interleaving bead 14 may not merely be rolled out of the way by the larger interleaving bead 14 (as shown in FIG. 8B). Instead, the smaller interleaving bead 14 may get wedged or locked underneath the larger interleaving bead 14, which may lead to damage to the substrate 12. Thus, the shipping system 10 of the present invention may have substantially all of the interleaving beads 14 with a radius at or above $D_{min}$ according to the following formula:

$$D_{min} \geq D_{max}\mu^2,$$

where $D_{max}$ is a diameter corresponding to a size of an opening of an upper limit sieve used in the shipping system and μ is a friction coefficient between the interleaving beads 14 and the substrate 12. In this context, "substantially all" means at least 75%, such as at least 80%, at least 85%, at least 90%, at least 95%, or 100%. In one example, based on this equation and assuming a friction coefficient of 0.5, the size of the smallest interleaving beads 14 should not be less than ¼ of the size of the largest interleaving bead 14.

Figure 8C:
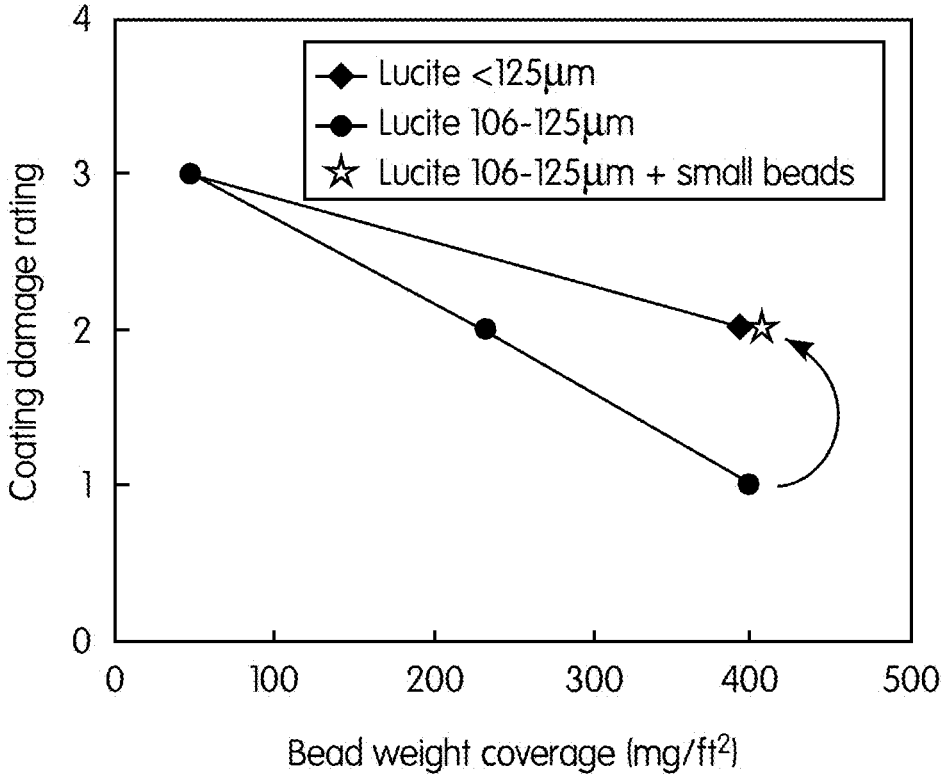
FIG. 8C is a graph showing a coating damage rating associated with different bead size distributions and interleaving bead densities.

An example of interleaving bead size distribution and coverage effects are shown in FIG. 8C. In this example, the interleaving bead coverage of the interleaving beads 14 in the shipping system 10 may range from 25 mg/ft$^2$ to 425 mg/ft$^2$. In other examples, a different interleaving bead coverage may be used to prevent failure of the interleaving beads 14. Increasing the interleaving bead coverage may reduce the damage to the substrates 12 during shipment. In the graph of FIG. 8C, the effect of altering the interleaving bead coverage was evaluated using a damage rating scale of 0-4. A damage rating of 0 meant no visual damage to the substrate 12. A damage rating of 1 meant microscopic wormtracks and other abrasion marks appeared on the coated substrate 12. A damage rating of 2 meant small visible wormtracks and other abrasion marks appeared on the substrate 12. A damage rating of 3 meant visible wormtracks and other abrasion marks over several regions appeared on the substrate 12. A damage rating of 4 meant large visible wormtracks and other abrasion marks, and large areas of failure appeared on the substrate 12. Generally, as the interleaving bead coverage increased, the damage rating improved. Additionally, the interleaving beads 14 with narrower size distribution (e.g., 106 μm to 125 μm) showed an improved performance as compared to interleaving beads 14 with wider size distribution (e.g., <125 μm). This difference may be due to (i) a larger number of load carrying interleaving beads 14 in the tighter size distribution having the same interleaving bead coverage may be the wider size distribution and (ii) the interaction between the very small interleaving beads 14 (see FIGS. 8A and 8B) and larger interleaving beads 14. To confirm the bead-bead interaction effects, the very small interleaving beads 14 may be added to a sample interleaved with tight size distribution to see the effect of very small interleaving beads 14 while the number of load carrying interleaving beads 14 is not changed. The curved arrow in FIG. 8C shows an increase in the transit damage when the very small interleaving beads 14 are added due to the smaller interleaving beads 14 getting wedged under the large interleaving beads 14 at higher interleaving bead coverage, leading to a worsened coating damage rating at higher interleaving bead coverage. In one embodiment of the present shipping system 10, an interleaving bead coverage may be provided such that substantially all of the interleaving beads 14 in the shipping system 10 do not fail while carrying the load, as described above. In this context, "substantially all" means at least 75%, such as at least 80%, at least 85%, at least 90%, at least 95%, or 100%.

B. Preventing Packing Pressure Points Using Spacers

As previously discussed, the transit damage may affect certain areas of the substrate 12 significantly more than other areas. This may be due to the fact that the pressure distribution between the substrates 12 may not be uniform and certain areas may be under excessive pressure while in other areas there may be little or no pressure. To prevent the transit damage, it may be desirable to minimize the localized high-pressure areas. To do so, the source of the pressure may be identified and the pressure points may be minimized by optimization of the packaging configurations. In cases where the high-pressure areas are unavoidable, a localized higher interleaving bead coverage at the high-pressure areas may address the issues, if feasible in terms of process limitations. The interleaving material 14 may be spherical beads or may be non-spherical instead, such as in the form of sheets, flakes, or powder. For instance, one half of the substrates 12 may experience severe transit damage while the other half is not damaged, the interleaving bead coverage may be increased as needed only in the half of the region that is prone to transit damage while the other half may not need any increase in interleaving bead coverage.

Figure 9:
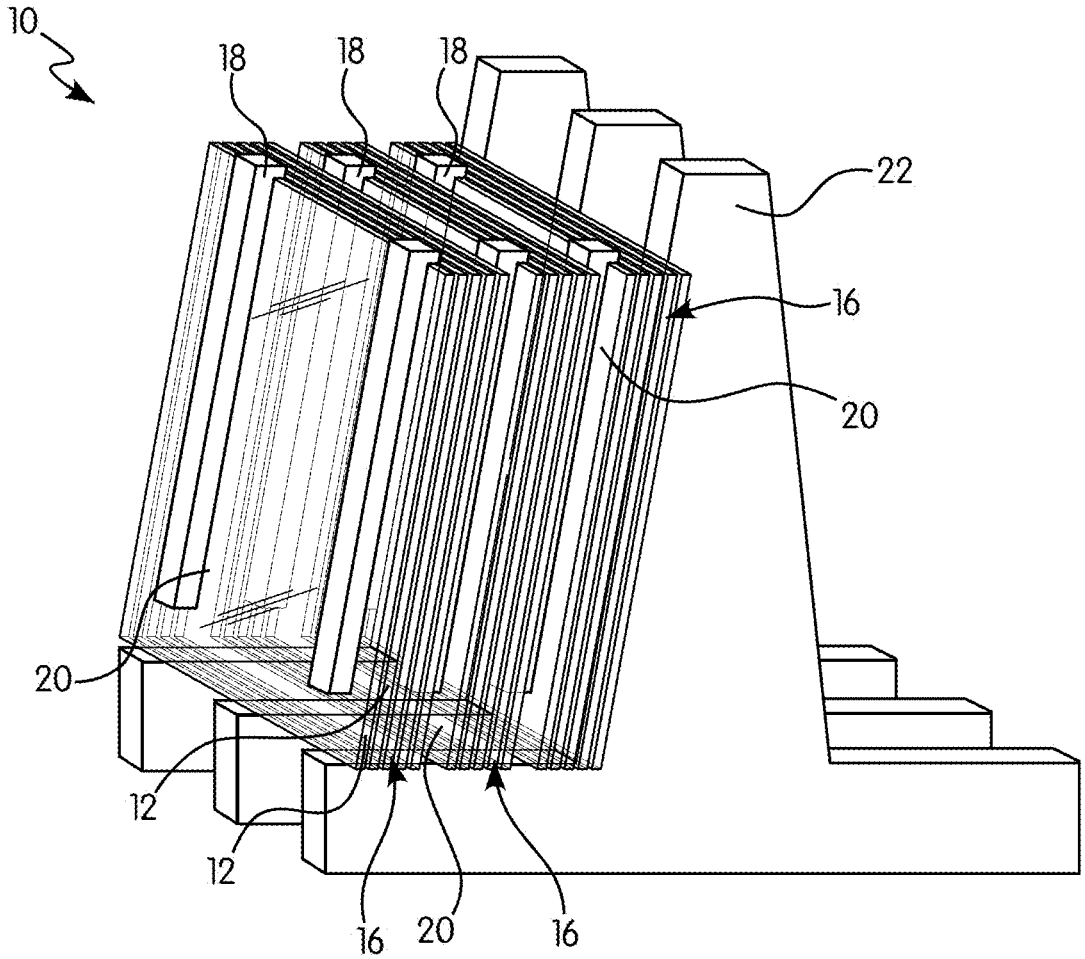
FIG. 9 (Prior Art)
FIG. 9 is a perspective view of a prior art shipping system.

One example of the source for high-pressure regions are spacers 18 between the packs 16. Referring to FIG. 9, the packs 16 of substrates 12 may be separated by at least one spacer 18 interposed between exposed faces 20 of the packs 16 and/or substrates 12 and include an area in contact with the exposed faces 20. The spacers 18 may protect the packs 16 during shipment from the manufacturing plant to the customer. The spacers 18 may be made of any suitable material for protecting the packs 16, including but not limited to Styrofoam (polystyrene) or honeycomb cardboard. The spacers 18 may be covered by an additional softer material (compared to the spacer material), including but not limited to polyethylene or polyurethane sheets. The softer material may be over a raised area 39 that is ⅛ inch thick or thicker, and thick enough to not compress so as to be flush with the spacer 18 under the load. The packs 16 and spacers 18 are loaded onto an A-frame 22 on, for instance, a truck. The A-frame 22 may be configured to support the packs 16 with a lean angle. In this example, the weight of the outside packs 16 may be transferred to inner packs through the spacers 18. Since the spacers 18 may cover only a portion of the pack's 16 surface, the weight of the outer packs 16 may result in the formation of high-pressure areas under the spacers 18. The higher pressure underneath the spacers 18 transfers through the packs 16 and may induce transit damage in some or all of the substrates 12 inside the packs 16.

Figure 10:
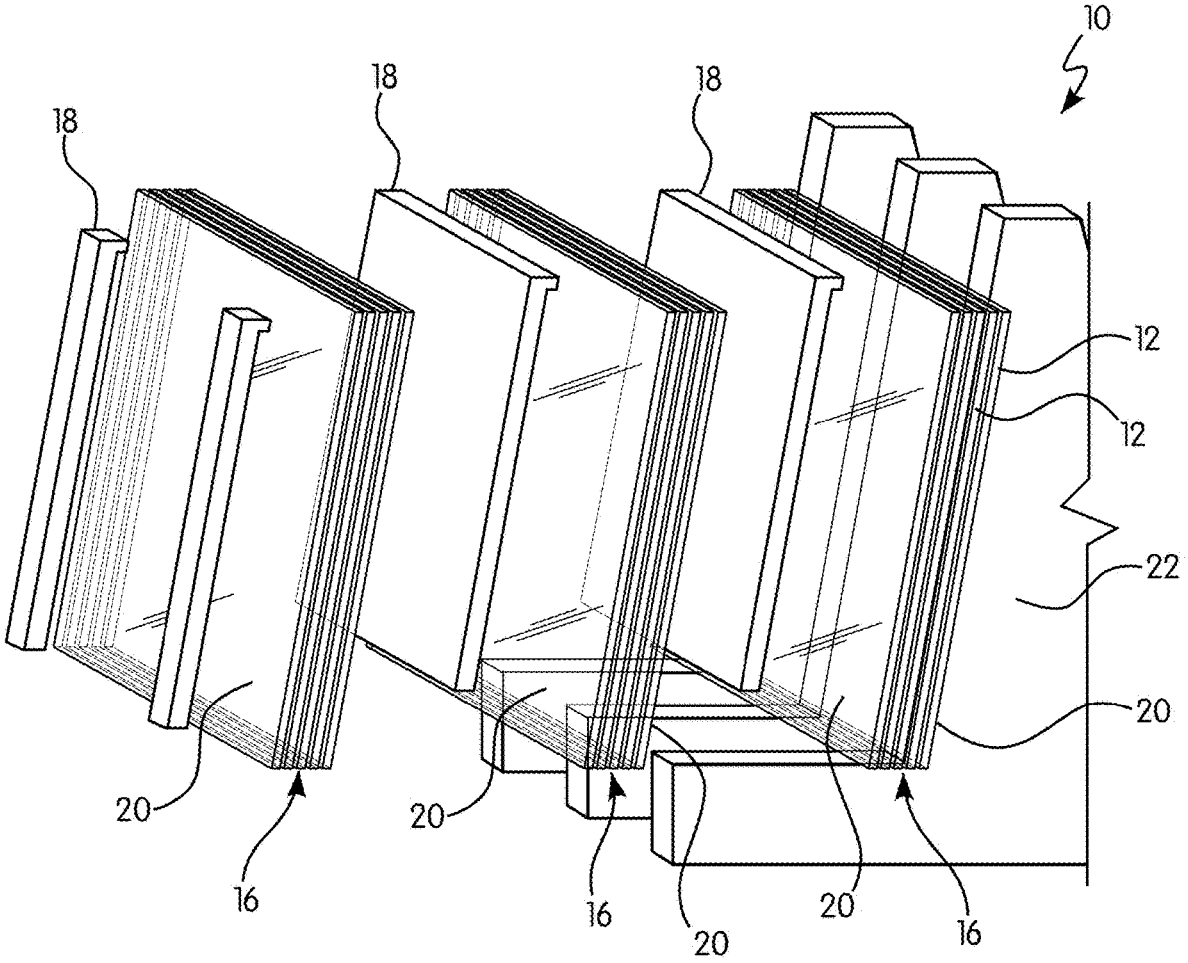
FIG. 10 is a perspective view of an exemplary shipping system according to the present invention having a continuous spacer.

To avoid high-pressure areas induced by the spacers 18, a continuous spacer 18 may be used. Referring to FIG. 10, the spacers 18 located between the packs 16 may be continuous sheets. The spacers 18 in this embodiment are in contact with the exposed faces 20 of the packs 16 that the spacers 18 are positioned between. The spacer 18 may be of a continuous thickness over the area in contact with the exposed faces 20 of the packs 16, and the area in contact with the exposed faces 20 of the packs 16 covers substantially an entire area of the exposed faces 20 of the packs 16 in contact with the spacer 18. The spacer 18 may be substantially the same width of the packs 16, and a single spacer 18 may be positioned between each of the packs 16. "Substantially the same" may be defined as at least 80% the same, at least 85%, at least 90%, at least 95%, or 100%. The continuous spacer 18 in this embodiment diffuses the entire load exerted on the pack 16 experiencing the load (e.g., from other packs) over the entire face of that pack 16.

Figure 11:
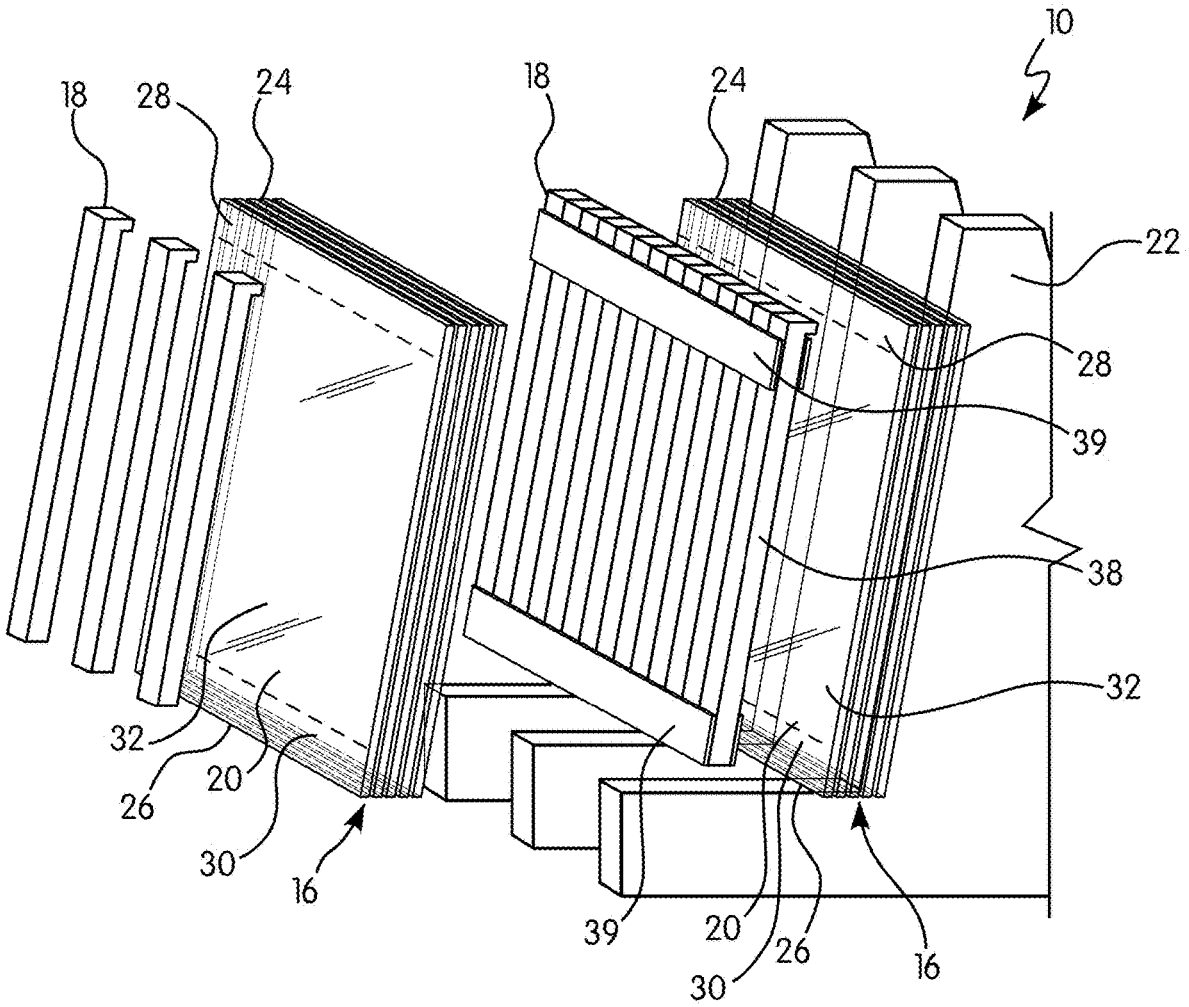
FIG. 11 is a perspective view of another exemplary shipping system according to the present invention having a single spacer in contact with the packs in first and second regions only, and having a first and second raised area.
Figure 12:
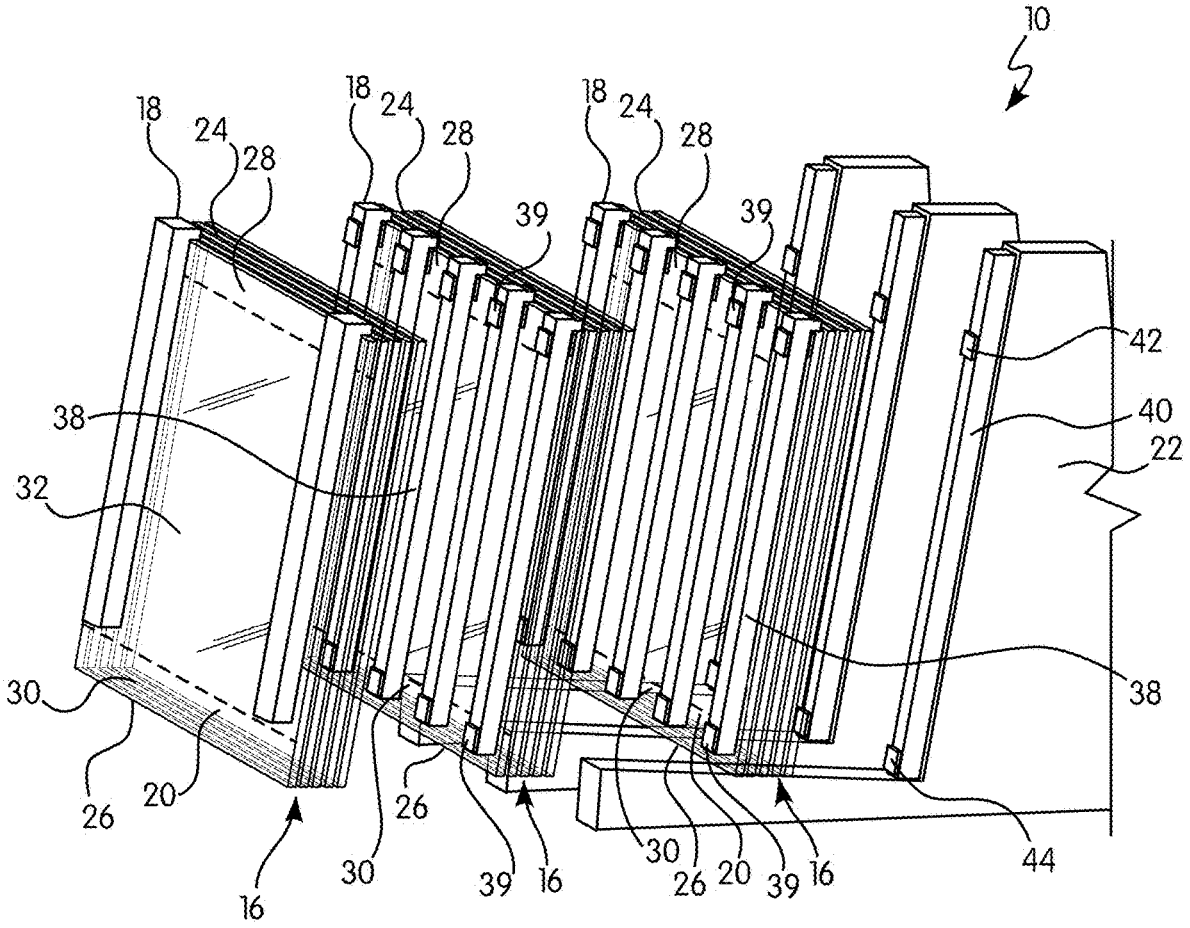
FIG. 12 is a perspective view of a further exemplary shipping system according to the present invention having multiple spacers in contact with the packs in the first and second regions only, and having the first and second raised area.

To minimize the area damaged during transit, the packaging configuration may be modified in a way that the load may be concentrated at smaller areas, preferably at areas that are usually being trimmed or discarded. This would prevent the damage to extend to a large area while it may make it more likely for the transit damage to occur at the areas with a concentrated load. Preferably, a higher coverage of interleaving beads 14 may be applied to the smaller areas with a concentrated load to offset for the higher pressure. Referring to FIGS. 11 and 12, the packs 16 and the substrates 12 in the shipping system 10 include a first region 28, a second region 30, and a third region 32 running between the first region 28 and the second region 30. In the example shown in FIG. 11, the first region 28 may be a horizontal region proximate to a first edge 24 of the pack 16, such as running from the first edge 24 of the pack 16. The first region 28 may extend 1 to 10% of the substrate height (such as 1, 2, 3, 4, 5, 6, 7, 8, 9, or 10%), such as 1 to 10% from the first edge 24 of the pack 16. In the example shown in FIG. 11, the second region 30 may be a horizontal region proximate to a second edge 26 of the pack 16, such as running from the second edge 26 of the pack 16. The second region 30 may extend 1 to 10% of the substrate height (such as 1, 2, 3, 4, 5, 6, 7, 8, 9, or 10%) of the pack 16. The third region 32 may extend between the first region 28 and the second region 30. The spacer 18 may be in contact with the exposed faces 20 of the first regions 28 and/or the second regions 30 of the packs 16. In one embodiment, after the substrate 12 arrives at its destination, the first region 28 and the second region 30 may be cut off of the substrate 12.

Figure 13:
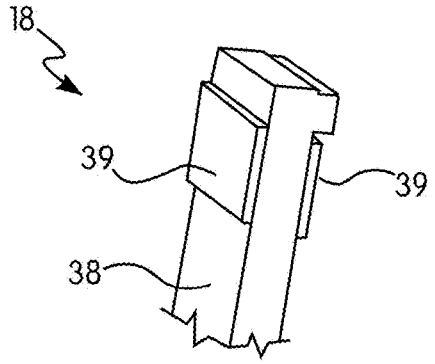
FIG. 13 is a perspective view of the spacer of FIG. 12.

Referring to FIGS. 11-13, the spacer 18 may include at least one raised area 39. The raised area 39 may be of any sufficient shape, including rectangular, circular, or any other shape. A first raised area 39 may be in contact with the exposed faces 20 of the first regions 28 of the packs 16. A second raised area 39 may be in contact with the exposed faces 20 of the second regions 30 of the packs 16. The raised areas 39 may include a sheet of softer material (compared to the material of the spacer 18). The spacer 18 may further include an elongated portion 38 running between the raised areas 39, with the elongated portion 38 not in contact with the exposed faces 20 of the packs 16. As in FIG. 11, a single spacer 18 may be used, or, as in FIG. 12, multiple spacers 18, such as five spacers 18, may be used.

With reference to FIG. 13, the raised areas 39 and the elongated portion 38 may be separate components with the elongated portion 38 made of polystyrene and the raised areas 39 may be made of softer materials, such as polyethylene or polyethylene foam. In another embodiment (not shown) the raised areas 39 may be an integrated piece of the spacer 18. The raised areas 39 may be designed so that only the raised areas of the spacer 18 are in contact with the packs 16. The raised areas may be of a sufficient thickness that they are not completely flattened (so as to be even with the remainder of the spacer 18) under the applied load.

The examples in FIGS. 11-13 may use the raised areas to concentrate the load in the first or second regions 28, 30 of the substrates 12 of the packs 16. This may minimize the area over which transit damage may occur on the substrates 12. The first and second regions 28, 30 may be located at the edges of the substrates 12 so that any transit damage that may still occur may be localized to the edges of the substrates 12.

Referring to FIGS. 14A-14E, various non-limiting embodiments of the spacer 18 are shown. The spacer 18 may include the elongated portion 38 having a first end 72 and a second end 74. The spacer may include a first side 78 and a second side 80 opposite the first side 78. A top flange 76 may be positioned at the first end 72 and may extend in a direction of the first side 78. The flange 76 may form an L-shape with the first side 72 of the elongated portion 38, and the first end 72 including the flange 76 may be a top end of the spacer 18. The flange 76 may be positioned over the top of the pack 16 when the elongated portion 38 is positioned over the exposed face 20 of the pack 16 when the spacer 18 is disposed between the packs 16. The raised area 39 may be in contact with the exposed face 20 of the pack 16, such as at an end of the exposed face 20 of the pack 16 (the previously described first contact region 42 and second contact region 44). The raised area 39, as previously described, may be positioned on the elongated portion 38. The elongated portion 38 may include more than one raised area 39. The raised area(s) 39 may be positioned on the first end 72 and/or the second end 74 of the spacer 18. Raised areas 39 positioned on the first end 72 may support a higher load than raised areas 39 positioned on the second end 74. The raised areas 39 positioned on the first end 72 may be mechanically robust enough to minimize issues associated with storage of packs 16 (such as spacer material collapsing under weight of heavy packs, thereby increasing a lean angle of the packs 16). As such, the thickness of the raised areas 39 on the first end 72 and the second end 74 may be different, with the raised area 39 on the first end 72 being comparatively thicker to account for the larger pressure placed thereon. The raised area(s) 39 may be positioned on the first side 78 of the second side 80 of the spacer 18. In one non-limiting embodiment, the spacer 18 includes the first raised area 39 positioned on the first side 78 of the first end 72 of the elongated portion 38 (below the flange 76) and a second raised area 39 positioned on the first side 78 of the second end 74 of the elongated portion 38. In one non-limiting embodiment, the second side 80 of the elongated portion 38 does not include any raised area 39. It will be appreciated from this disclosure that only one side 78, 80 may include a raised area 39 or both sides 78, 80 may include a raised area 39.

Figures 14A, 14B, 14C, 14D:
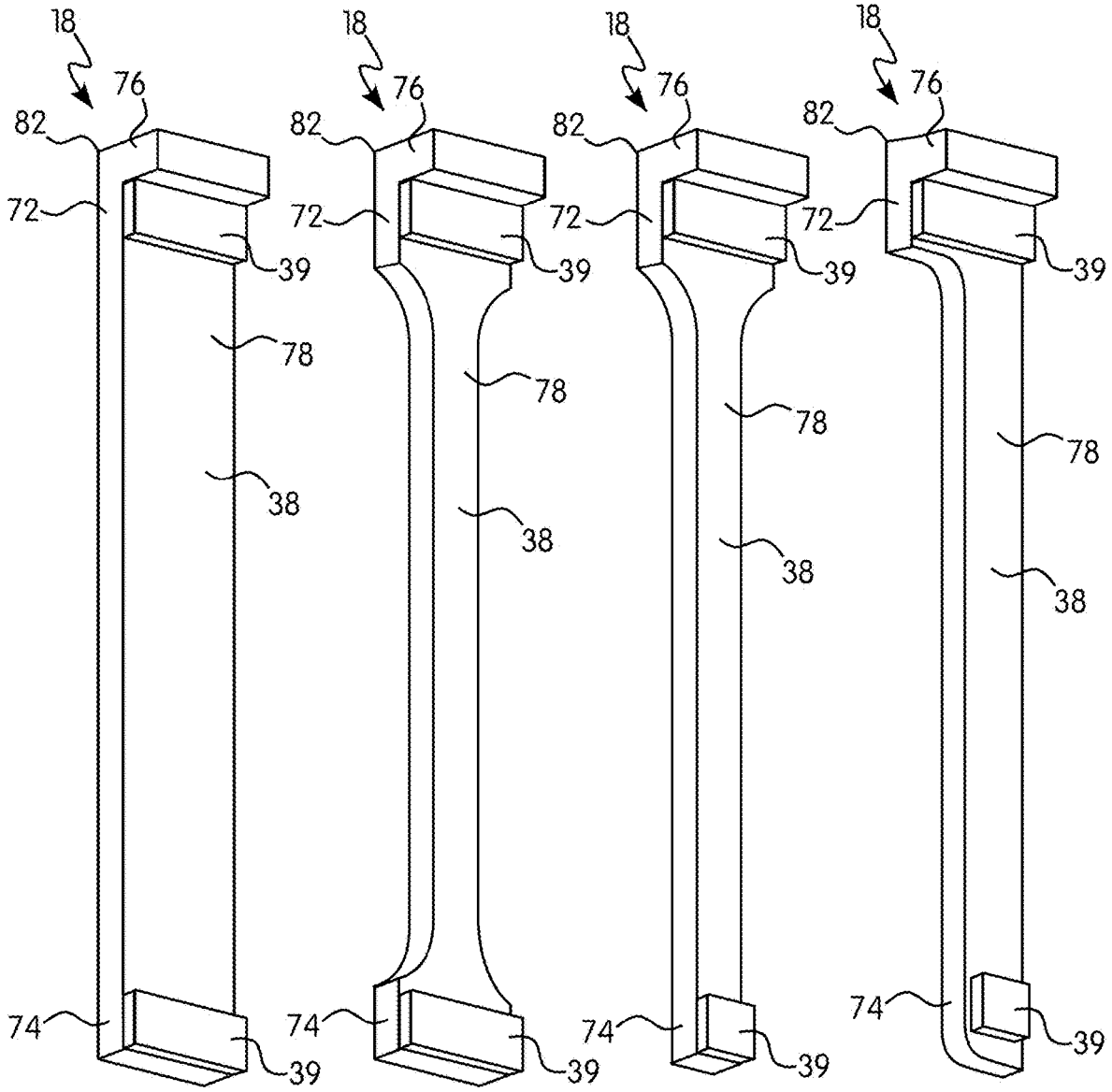
FIGS. 14A-14E are perspective views of various embodiments of spacers according the present invention.

With continued reference to FIGS. 14A-14E, the width of the elongated portion 38 may be the same or varied along the length of the elongated portion 38. As shown in FIG. 14A, the width of the elongated portion 38 may be identical along its length such that a width of the first end 72 is identical to a width of the second end 74, and the widths between the first end 72 and the second end 74 are identical thereto. As shown in FIG. 14B, the width of the elongated portion 38 at the first end 72 and the second end 74 may be identical with a section of the elongated portion 38 therebetween having a width smaller than the width at the first and second ends 72, 74. As shown in FIGS. 14C and 14D, the width of the elongated portion 38 at the first end 72 may be larger than the width of the elongated portion 38 at the second end 74. The ends 72, 74 of the elongated portion 38 may be squared (see FIGS. 14A-14E) or rounded (see FIG. 14D).

Figure 14E:
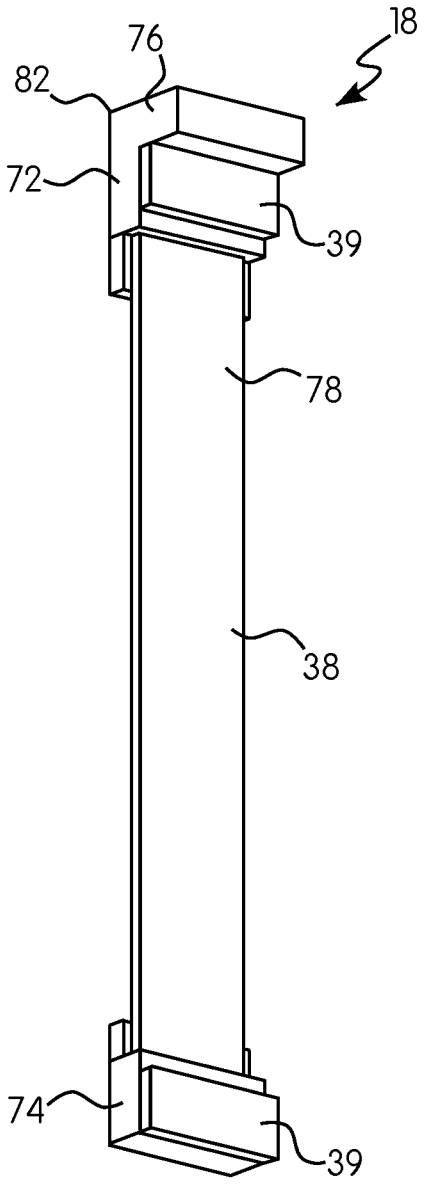

As shown in FIG. 14E, the elongated portion may be a separate component from the first end 72 and the second end 74 and have the same or different width as the first end 72 and the second end 74. The elongated portion 38 may also be made of a different materials from the first end 72 and the second end 74. For example, the first end 72 and the second end 74 may be made of polystyrene while the elongated portion is made of 38 cardboard, cloth, paper, or some different plastic material. In some embodiments, the material of the first end 72 and the second end 74 may be made of a more robust material, better able to support pressure from the packs 16 compared to the material of the elongated portion.

Figure 15A:
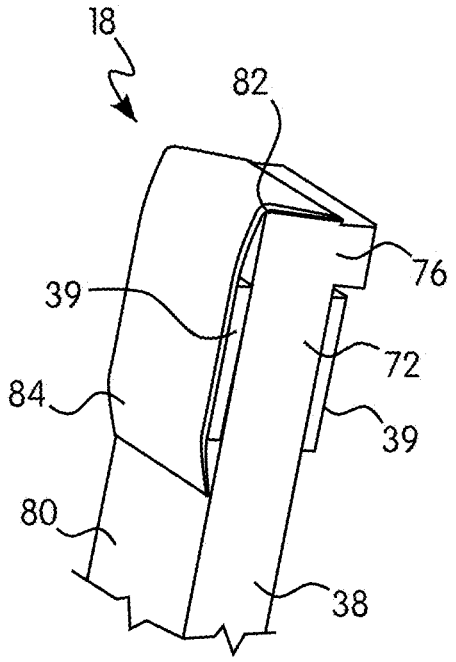
FIGS. 15A-15C are perspective views of various embodiments of spacers according the present invention.
Figure 15B:
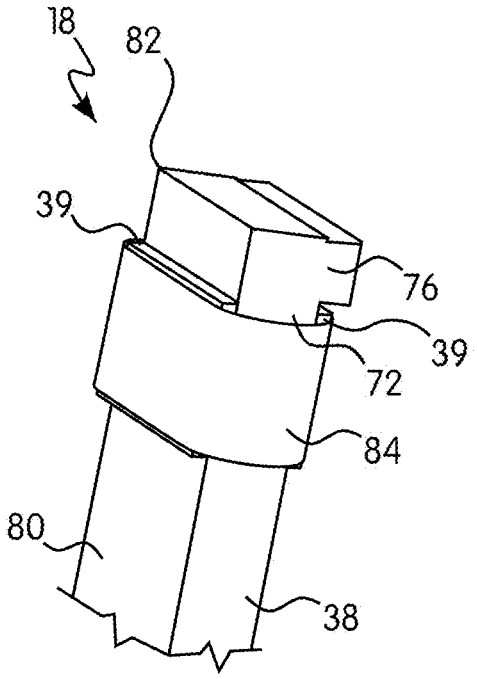
Figure 15C:
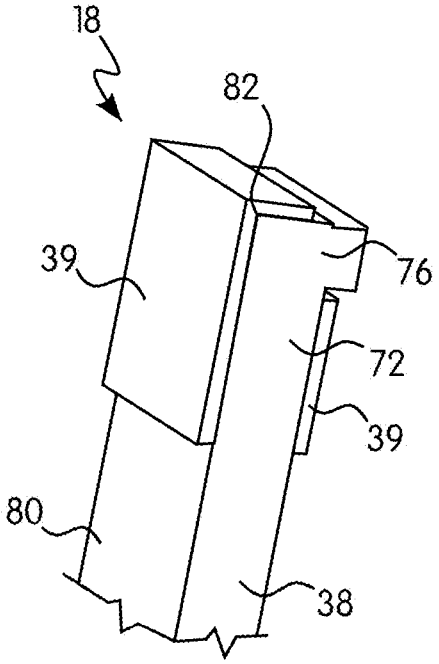

Referring to FIGS. 15A-15C, various non-limiting embodiments of the spacer 18 are shown. The spacer 18 may include the elongated portion 38 including a plurality of raised areas 39 disposed thereon. The elongated portion 38 may include a first raised area 39 positioned on the first side 78 of the first end 72 of the elongated portion 38 and a second raised area 39 positioned on the second side 80 of the first end 72 of the elongated portion 38. The second raised area 39 on the second side 80 of the first end 72 may extend over a corner 82 of the elongated portion 38, as shown in FIG. 15C (so as to cover a top end part of the first end 72). Tape 84 may be included to cover at least one of the raised areas 39, as shown in FIGS. 15A-15C.

C. Preventing Packing Pressure Points Using Selective Increased Bead Coverage

Damage that may occur around the edges of the substrate 12 using the spacers 18 in FIGS. 11-13 may be further reduced, or even eliminated, by applying a higher interleaving bead coverage of interleaving beads 14 in the area of the first and second regions 28, 30 of the substrates 12 (or other region in which a raised area 39 is in contact with the substrate 12), compared to the interleaving bead coverage in the third region 32. This may allow for more interleaving beads 14 to provide increased support in the regions 28, 30 where the load may be concentrated. For example, the interleaving bead coverage may be 2 to 20 times greater (such as 4 to 20, 6 to 20, 8 to 20, 10 to 20, 12 to 20, 14 to 20, 16 to 20, or 18 to 20) between the first and second regions 28, 30 of the substrates 12 compared to the interleaving bead coverage between the third regions 32 of the substrates 12. An even higher relative interleaving bead coverage may be applied to the first and second regions 28, 30 of the substrates 12 if doing so further reduces transit damages to these regions 28, 30. Where the interleaving material 14 includes very small interleaving beads 14 (see FIGS. 8A and 8B), the very small interleaving beads 14 may be removed from the interleaving bead 14 size distribution, especially if the interleaving bead coverage is high to an extent that bead-bead interaction is very likely. The size range of the small beads that may be removed to minimize or avoid transit damage have been described above.

For substrates 12 having a higher interleaving material coverage in the first and second regions 28, 30, the substrate 12 may be prepared by first coating the first, second, and third regions 28, 30, 32 with the interleaving material coverage desired in the third region 32, and then coating the first and second regions 28, 30 with further interleaving material 14 until the desired, denser interleaving material coverage in the first and second regions 28, 30 is reached. Alternately, the substrate 12 may first have the denser interleaving material coverage applied in the first and second regions 28, 30, and then apply the desired interleaving material coverage to the third region 32. However, it is to be appreciated that the substrate 12 can be coated with the desired interleaving material coverage in any region of the substrate 12 using any suitable method or sequence. The interleaving material coverage in any specific region of the substrate 12 may be commensurate with the pressure between the substrates 12 in that region.

D. A-Frame

Referring back to FIG. 12, the A-frame 22 may include a strut 40 in contact with the exposed face 20 of one of the packs 16. The example in FIG. 12 includes the A-frame 22 with three struts 40, but the A-frame 22 may include more or fewer struts 40. For example, the A-frame 22 may include a single, continuous strut 40. The struts 40 may be configured to support the packs 16 which lean against the A-frame 22. The struts 40 may be made, for instance, of polystyrene. In the case of a single-strut A-frame 22, the strut 40 may be in contact with substantially the entire exposed face 20 of the pack 16 in contact with the strut 40. In the example shown in FIG. 12, the struts 40 may include one or more contact regions 42, 44, the contact regions 42, 44 including the softer material (compared to the material of the strut 40). The contact regions 42, 44 may be raised from the strut 40 and may include a first contact region 42 and a second contact region 44. In this example, the first contact region 42 may be in contact with the exposed face 20 of the first region 28 of the pack 16 in contact with the strut 40, and the second contact region 44 may be in contact with the exposed face 20 of the second region 30 of the pack 16 in contact with the strut 40. The contact regions 42, 44 may be of a sufficient thickness that they are not completely flattened (so as to be even with the remainder of the strut 40 under the applied load).

E. Wrapping System

In one non-limiting embodiment, the high-pressure area may be induced by the providing wrap 17 around the pack 16. Referring to FIG. 1, the pack 16 may be wrapped by the wrap 17 for safety reasons to further hold the pack 16 together, or for protection against environment. The wrap 17 may be made of any suitable material, such as a plastic wrap. The wrap 17 may be loosely wrapped around the pack 16 so as to minimize pressure points induced by the wrap 17 on the pack 16. The concentrated pressure at the edges of the pack 16, may be reduced by wrapping the wrap 17 around the pack 16 as loosely as the process would allow, or by reducing the overlap of the wrap 17 as the wrap 17 may be applied around the pack 16. For example, reducing the tension in the wrap 17 by a factor of two and reducing the overlap from 75% overlap to 50% may reduce the localized pressure by a factor of four. To estimate how much tension and how much overlap should be used in the wrapping system, the maximum force that may be handled by beads may be taken into account. The previously discussed method to estimate the maximum force that may be applied to a given interleaving bead size distribution without causing transit damage may be used. The force applied at the edge of the pack 16 due to the wrap 17 may be estimated according to the following formula:

$$F/L=T/(w*(1-\alpha)),$$

in which F is the force applied at the substrate edge, L is the length of the substrate edge, T is the tension in the wrap, w is the width of the wrap, and $\alpha$ is the percentage of overlap. As previously discussed, additional interleaving material 14 may be included at the edge of the pack 16 to prevent transit damage caused by the force from the wrap 17.

Figure 16:
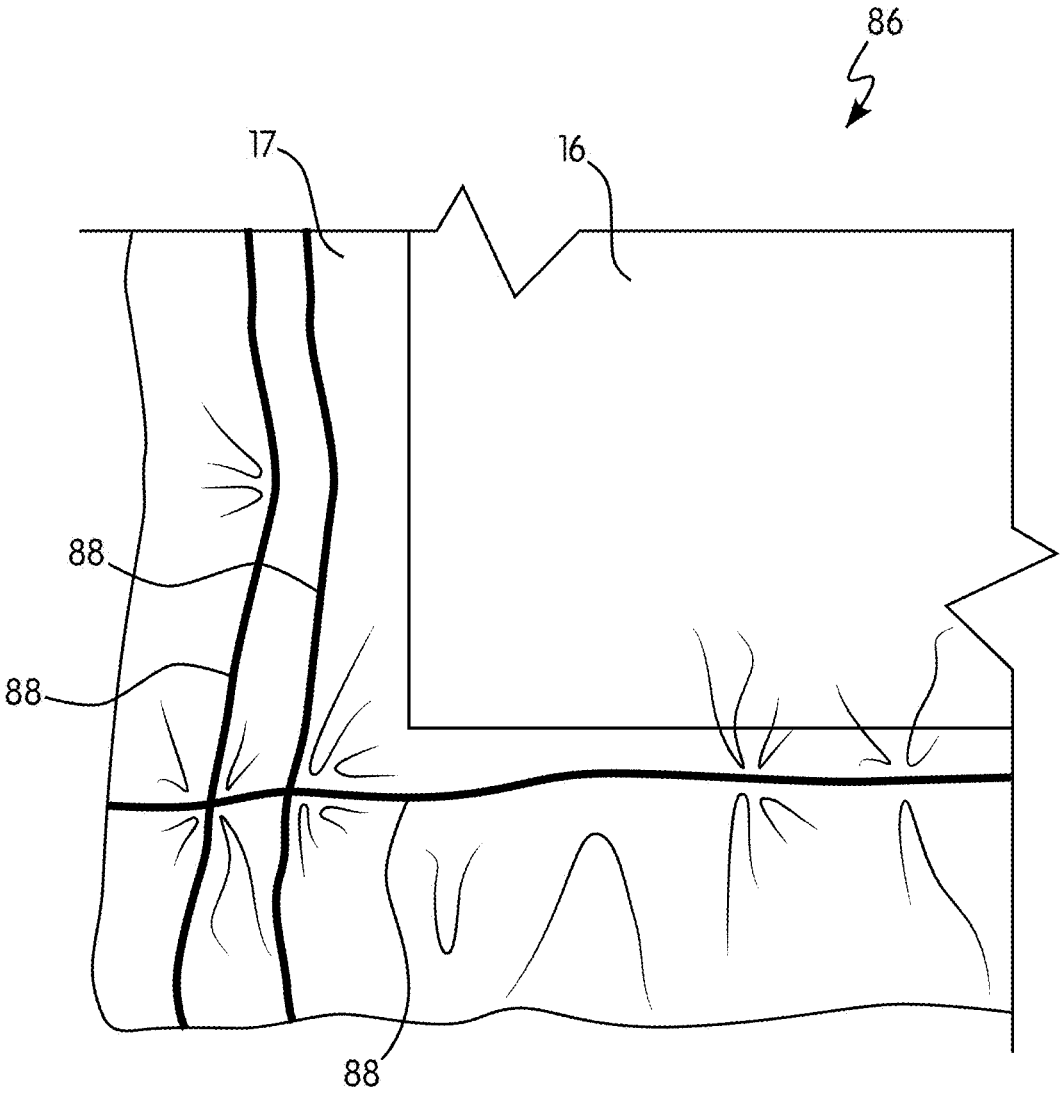
FIG. 16 is a perspective view of a thermally sealed plastic wrap used in a wrapped system according to the present invention.

Referring to FIG. 16, in another non-limiting embodiment a wrapped system 86 as shown may be provided. The wrapped system 86 may be a system for shipping the previously-described planar substrates 12. The wrapped system 86 may include a plurality of planar substrates 12 stacked to form the pack 16. The wrapped system 86 may include the wrap 17 positioned around the pack 16. The wrap 17 may be sealed around the pack 16 by at least one seal 88 being formed around the pack 16.

The wrap 17 may be made of plastic or any other material suitable for sealing the pack 16 sufficiently tight such that moisture is prevented from reaching the pack 16. The plastic material of the wrap 17 may be polyethylene. The wrap 17 may be corrugated plastic wrap. A single sheet of wrap 17 may be used to surround and seal the pack 16 in the wrapped system 86. The wrap 17 may be sealed around the pack 16 by thermally sealing the wrap 17. This may include increasing the temperature of the wrap 17, such as plastic wrap, so as to melt the material of the wrap 17 to create the seal 88 capable of preventing moisture from reaching the pack 16. However, it will be appreciated that the seal 88 may be formed in the wrap 17 using any other suitable method.

The wrapped system 86 may have air removed therefrom such that air is partially or completely removed from a region between the wrap 17 and the pack 16. Air may be removed from the wrapped system 86 prior to completely sealing the wrap 17. In some non-limiting embodiments, the wrapped system 86 may be partially sealed, air removed by way of the unsealed region, and then the unsealed region completely sealed to completely seal the wrapped system 86. Removal of the air may create a vacuum in the wrapped system 86 between the pack 16 and the wrap 17. The wrapped system 86 may be free of openings in the wrap 17 after the wrap 17 is sealed such that there are no opening through which gas and/or liquid may penetrate, such as air and/or water.

Referring to FIGS. 17-24, a wrapping apparatus 90 may be used to seal the wrap 17 around the pack 16 to form the wrapped system 86. The wrapping apparatus 90 may include a pack bay 92, which may be a platform on which packs 16 may be placed for wrapping with the wrap 17. The wrapping apparatus 90 may also include at least one wrap spool 94 about which the wrap 17 is wound before it is wrapped around the pack 16. The wrap spools 94 may be positionably fixed or transitional to effect wrapping of the pack 16. The wrap spools 94 may be rotatable to unwind the wrap 17 or to wind the wrap 17 around the wrap spools 94. The wrapping apparatus 90 may include at least one side sealer 96 configured to effect sealing of the sides of the wrap 17. The side sealer 96 may be rotatable so as to rotate at the desired time to effect sealing of the wrap 17. The side sealer 96 may include at least one thermal portion to heat up and contact the wrap 17, so as to form the seal 88. The wrapping apparatus 90 may include at least one top sealer 98 configured to effect sealing of the top of the wrap 17. The top sealer 98 may be rotatable so as to rotate at the desired time to effect sealing of the wrap 17. The top sealer 98 may include at least one thermal portion to heat up and contact the wrap 17, so as to form the seal 88.

Figure 17:
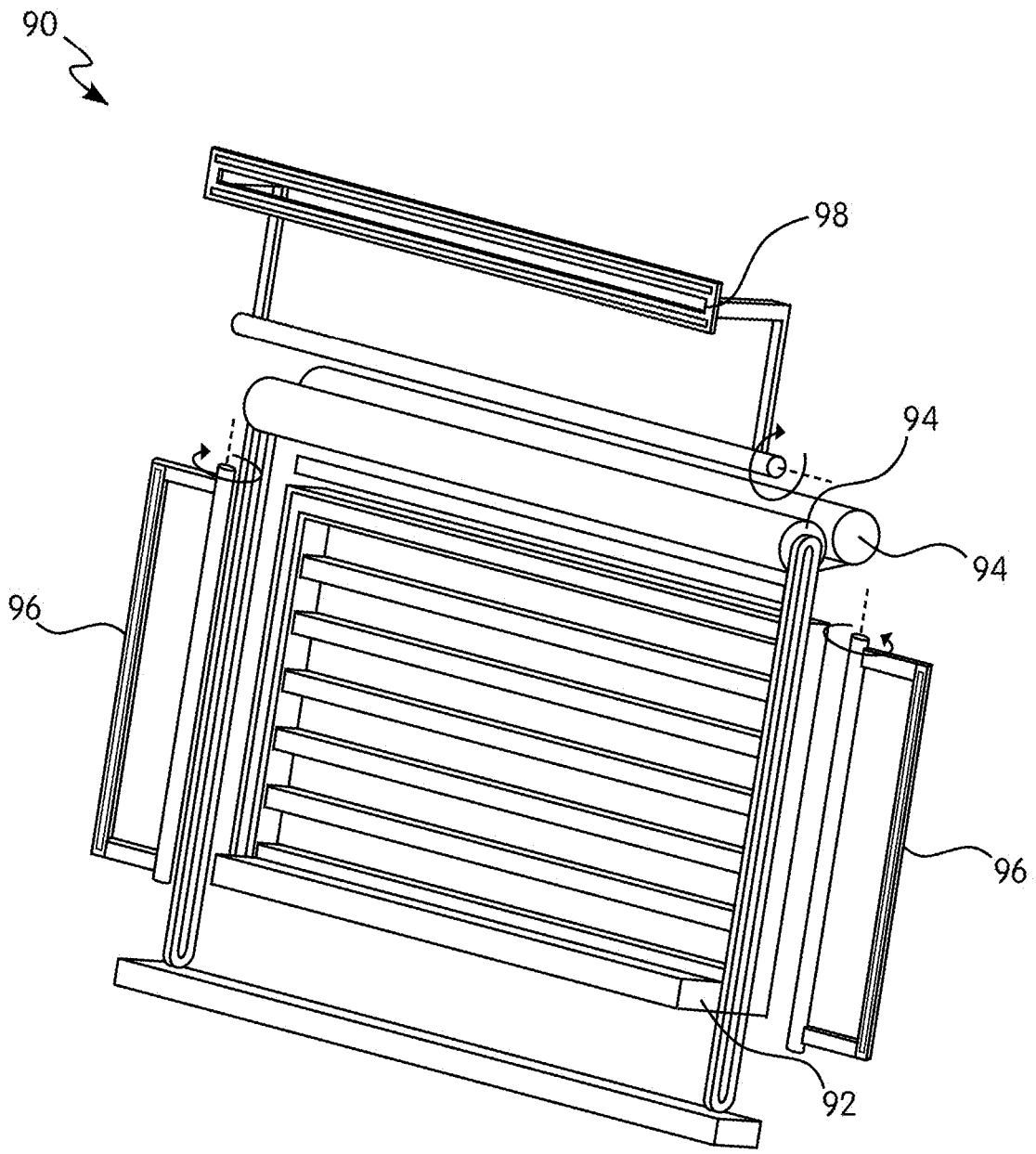
FIGS. 17-25C are perspective views of various steps of a method of wrapping a system for planar substrates according to the present invention using a wrapping apparatus.
Figure 18:
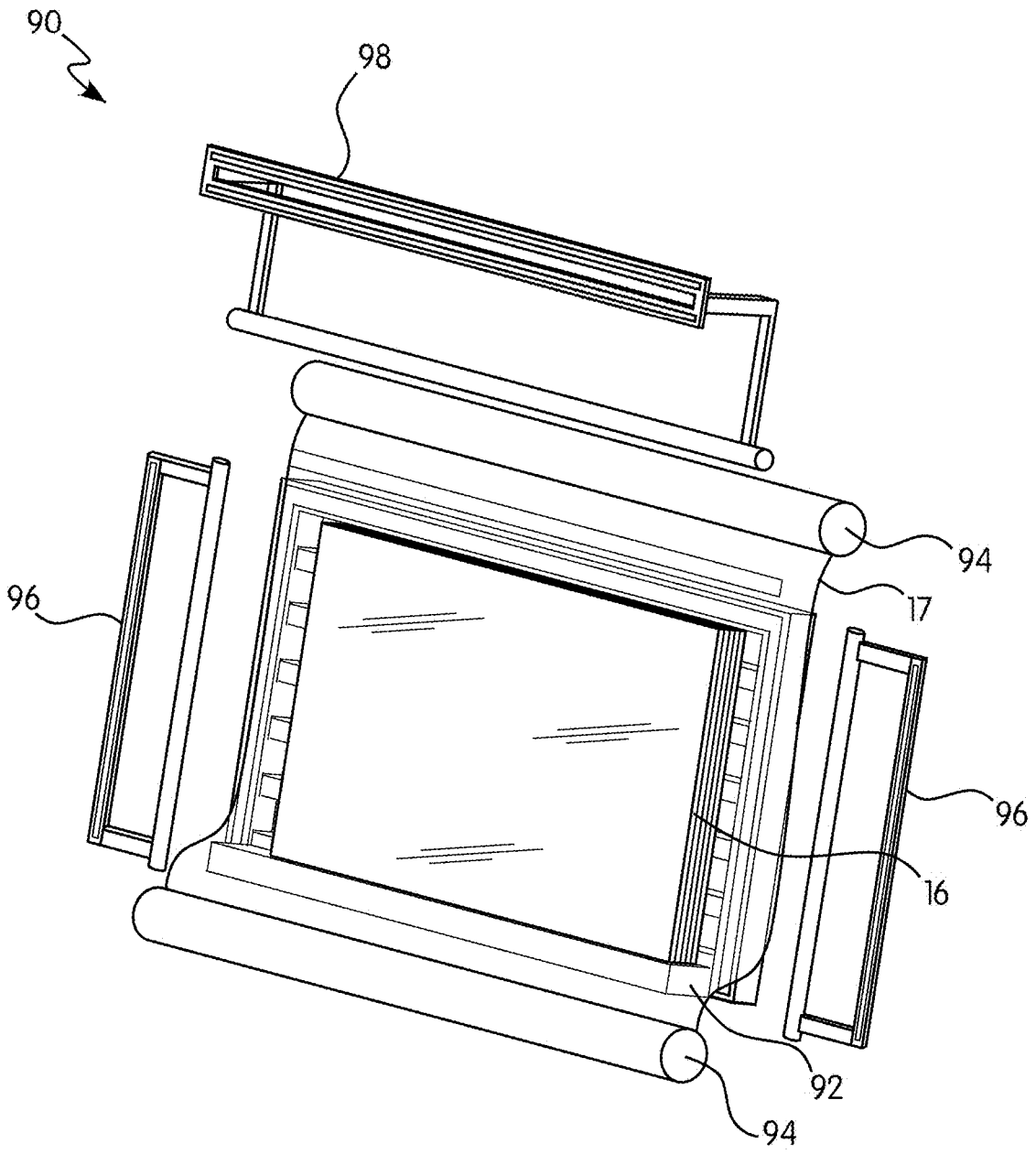
Figure 19:
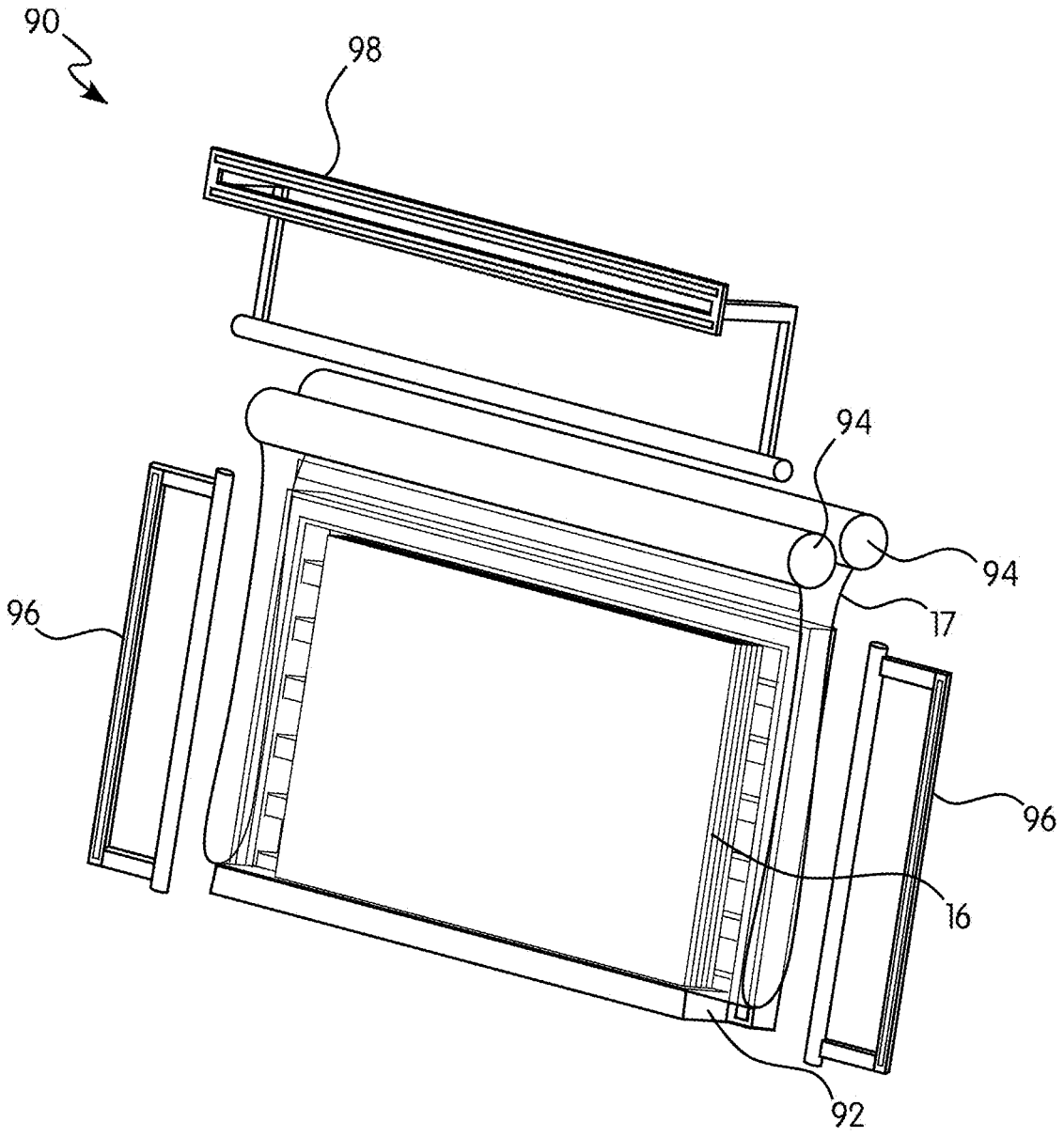
Figure 20:
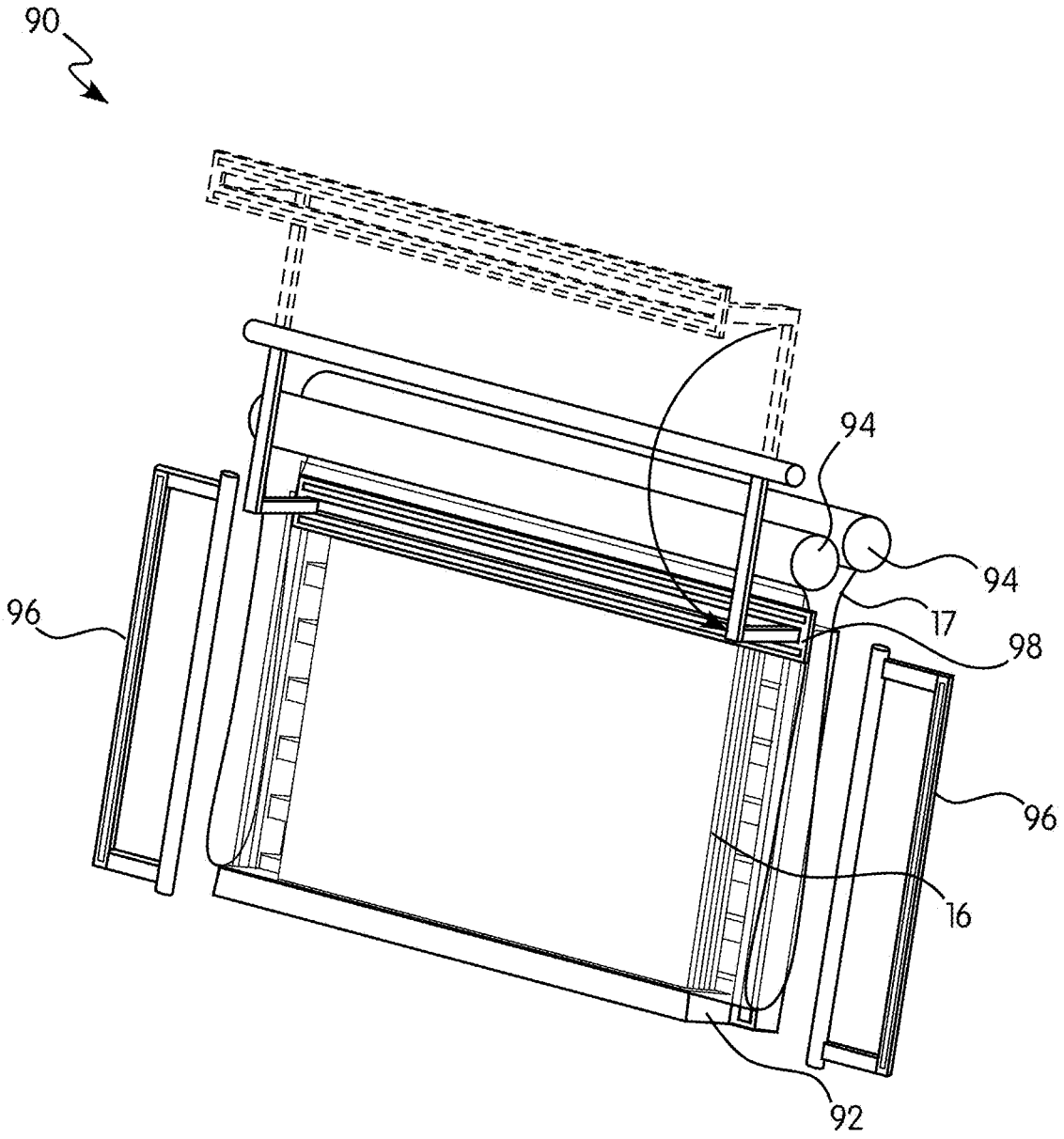
Figure 21:
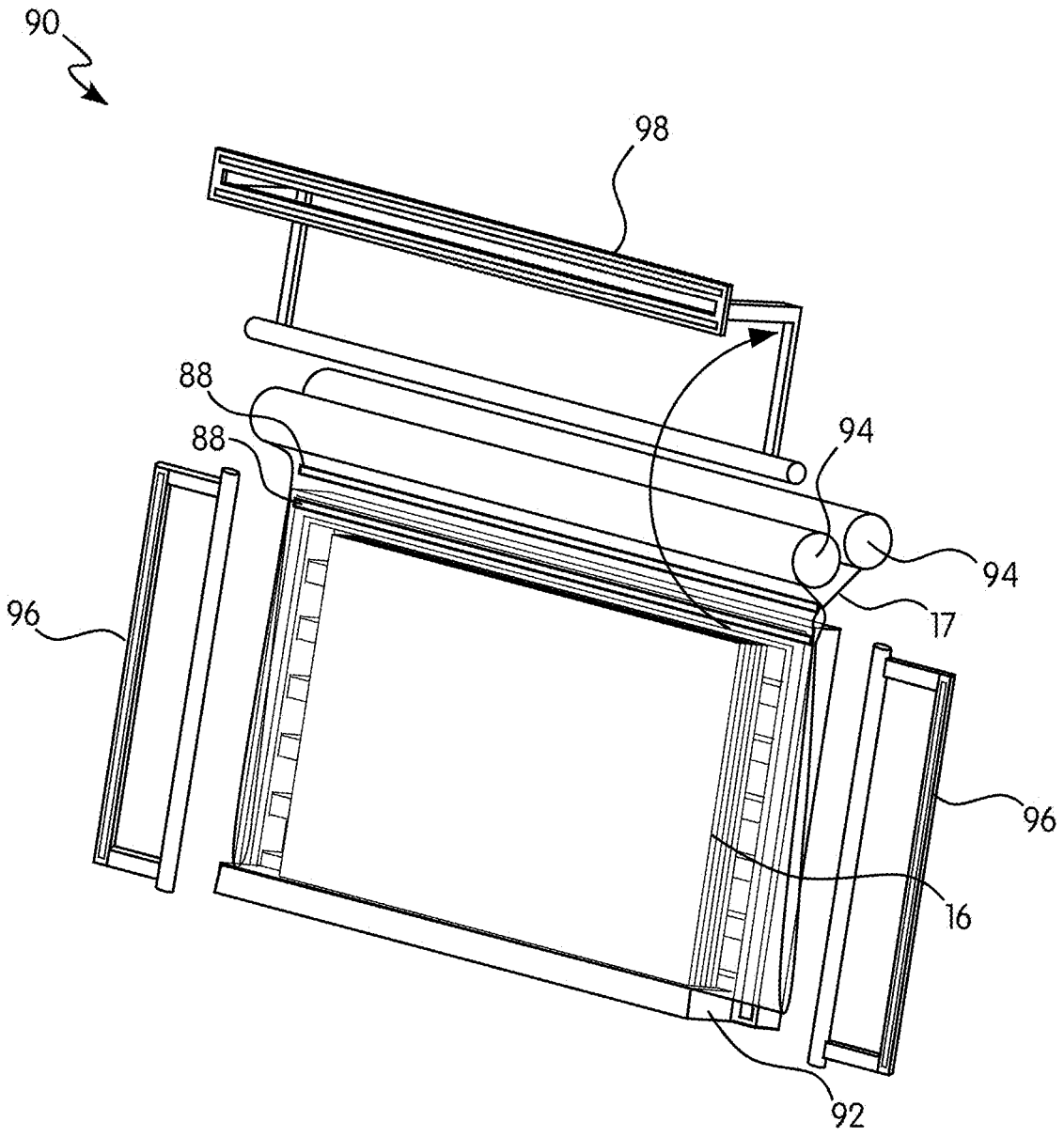
Figure 22:
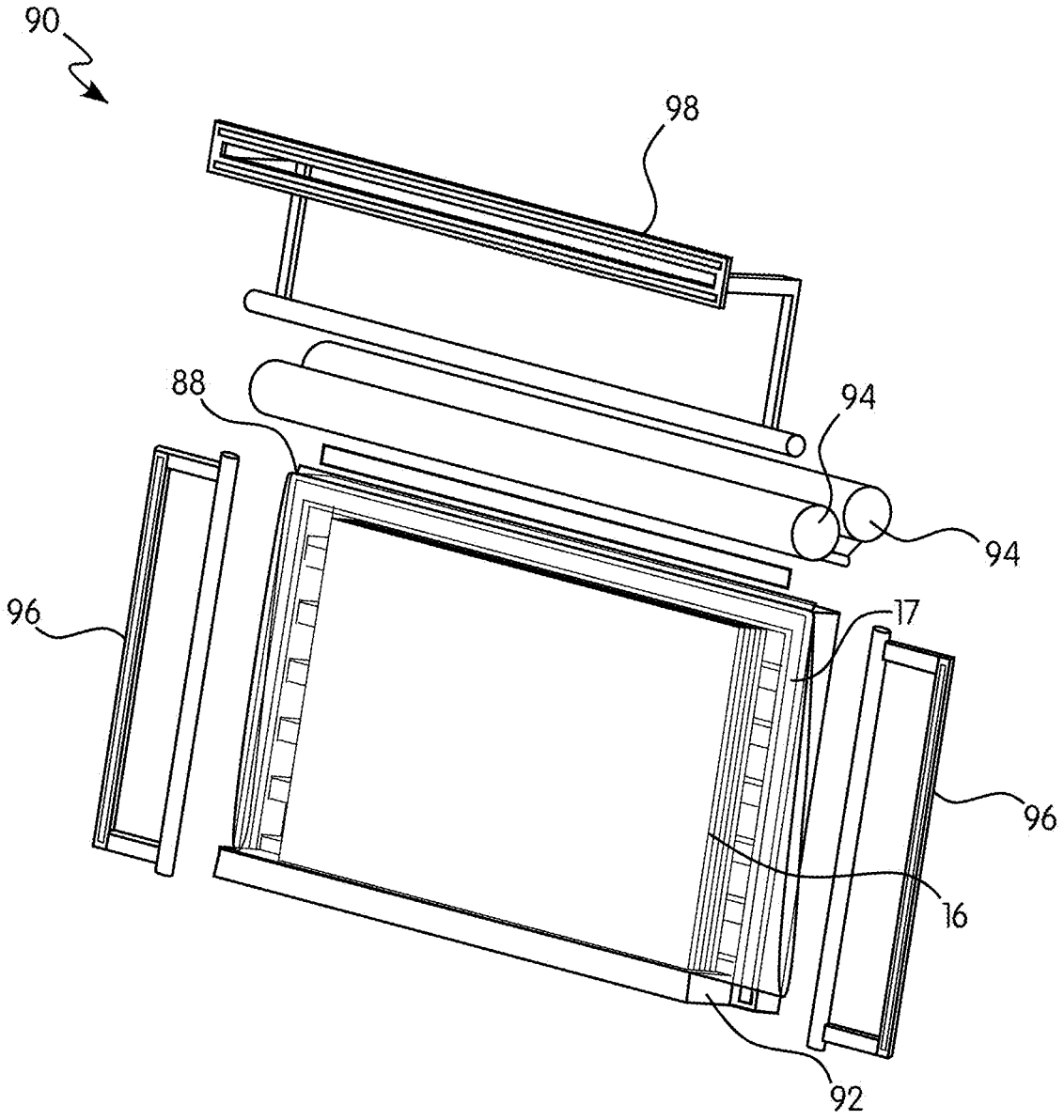
Figure 23:
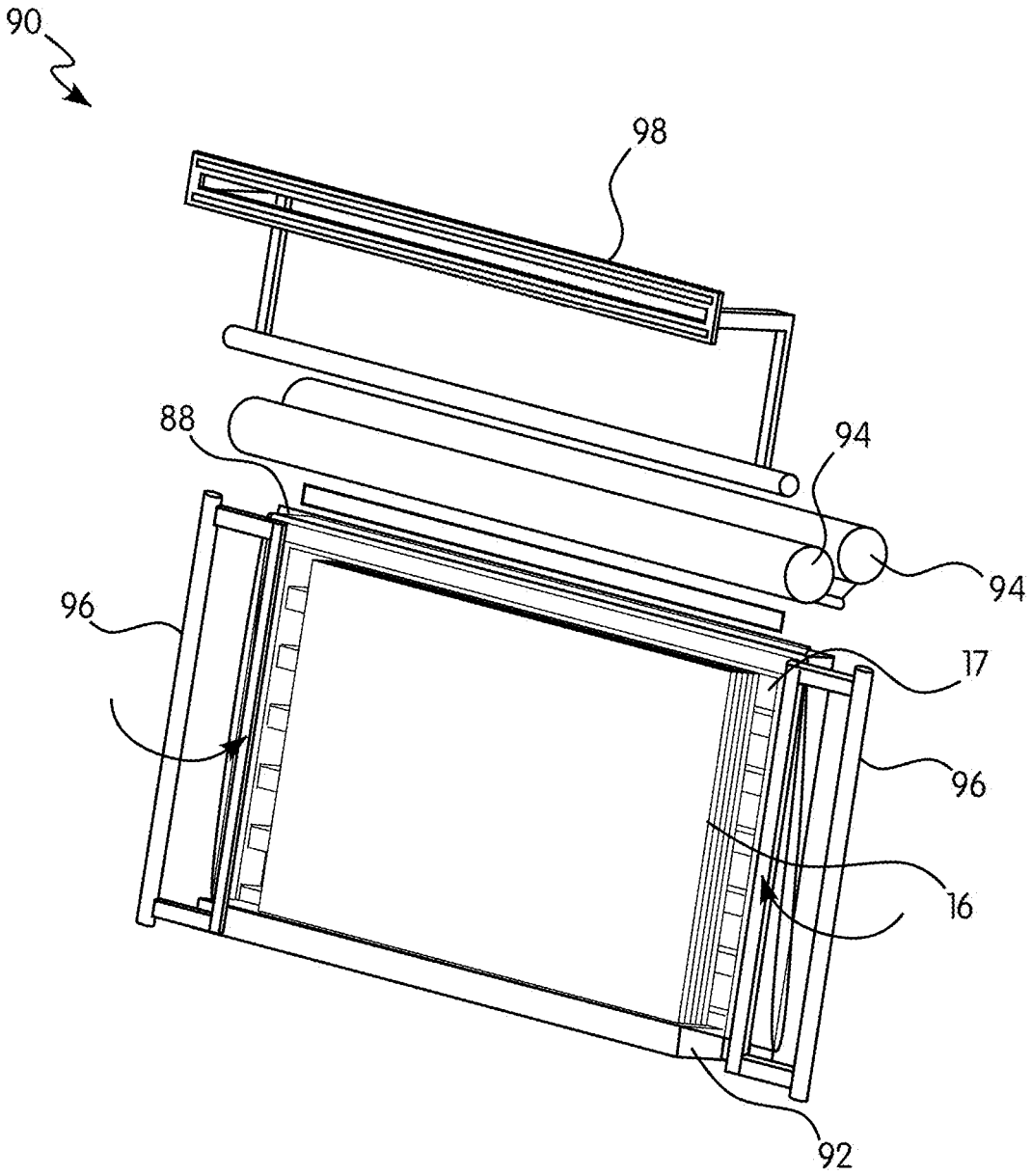
Figure 24:
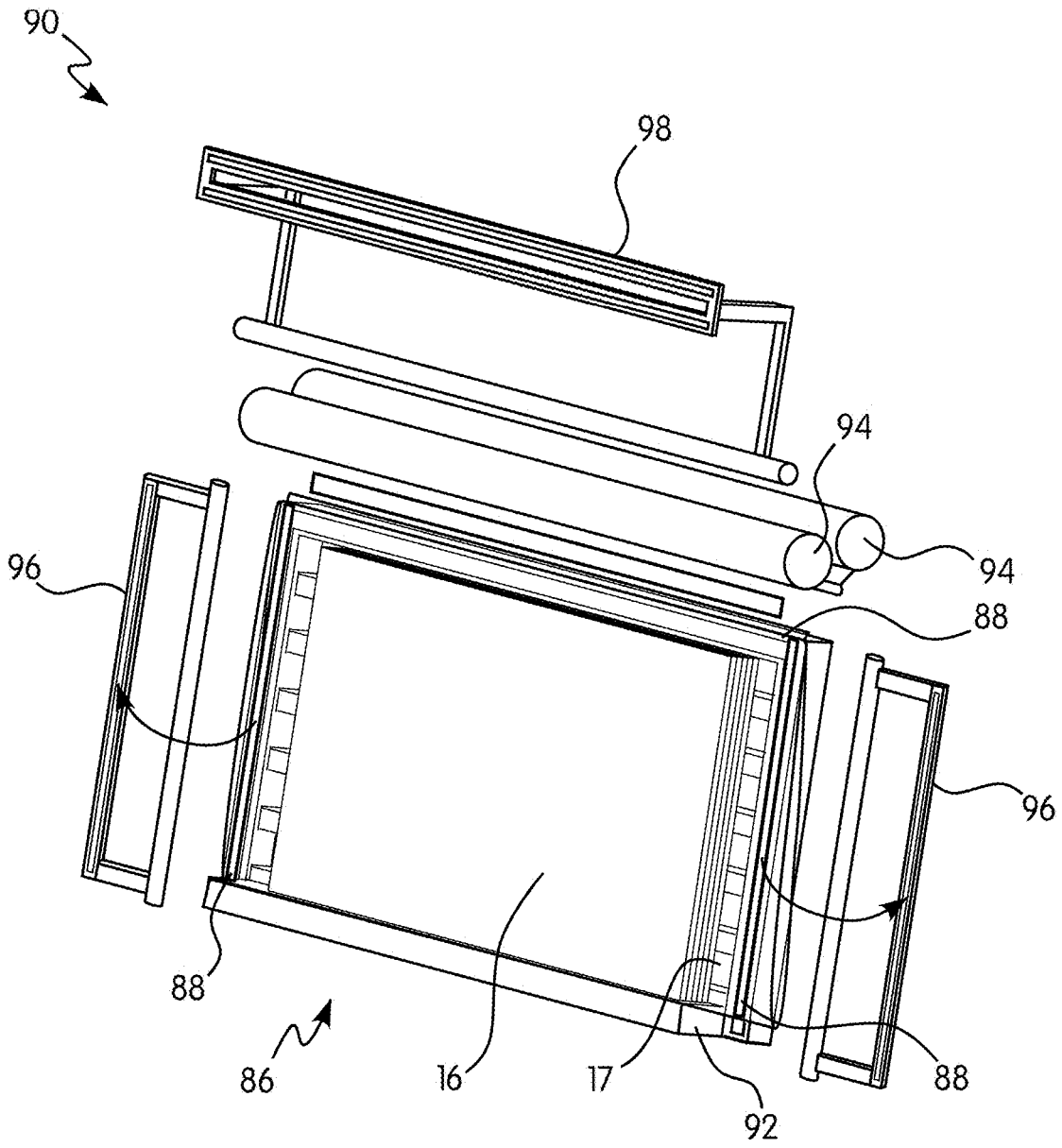

FIG. 17 shows a non-limiting embodiment of the wrapping apparatus 90 before the pack 16 is introduced to the pack bay 92. FIG. 18 shows a first wrap spool 94 translated down to the pack bay 92 and a pack 16 then placed on the pack bay 92 on the wrap 17 to partially wrap the pack 16. FIG. 19 shows the first wrap spool 94 translated back toward a second wrap spool 94 so that the pack 16 is surrounded on at least three sides by the wrap 17. FIG. 20 shows the top sealer 98 rotated down so as to contact the thermal portion with the wrap 17 to seal the top portion of the wrap 17 around the pack 16. FIG. 21 shows the top sealer 98 rotated away from the pack 16 after the seal 88 is formed in the wrap 17. FIG. 22 shows the wrap 17 cut away from the wrap spools 94 above the seal 88. FIG. 23 shows the side sealers 96 rotated around so as to contact the thermal portion with the wrap 17 to seal the side portions of the wrap 17 around the pack 16. FIG. 24 shows the side sealers 96 rotated away from the pack 16 after the seal 88 is formed in the wrap 17. In FIG. 24, the pack 16 is sealed completely by the wrap 17 to form the wrapped system 86.

Figure 25A:
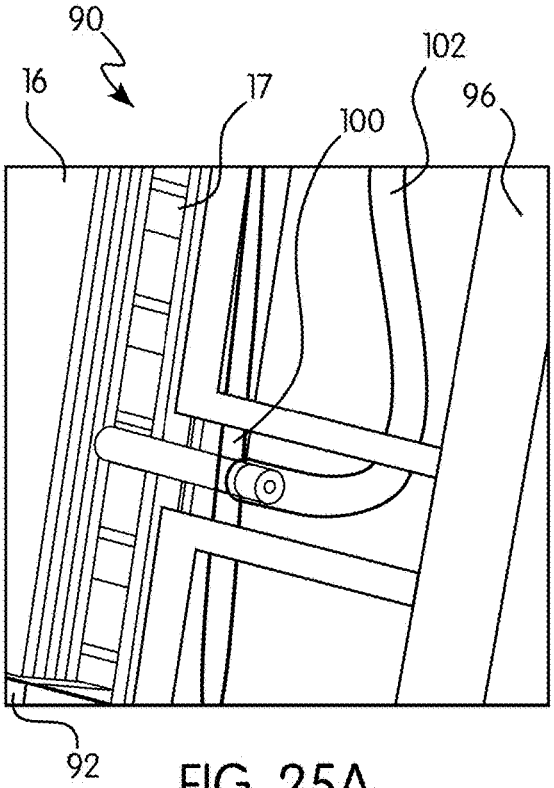
Figure 25B:
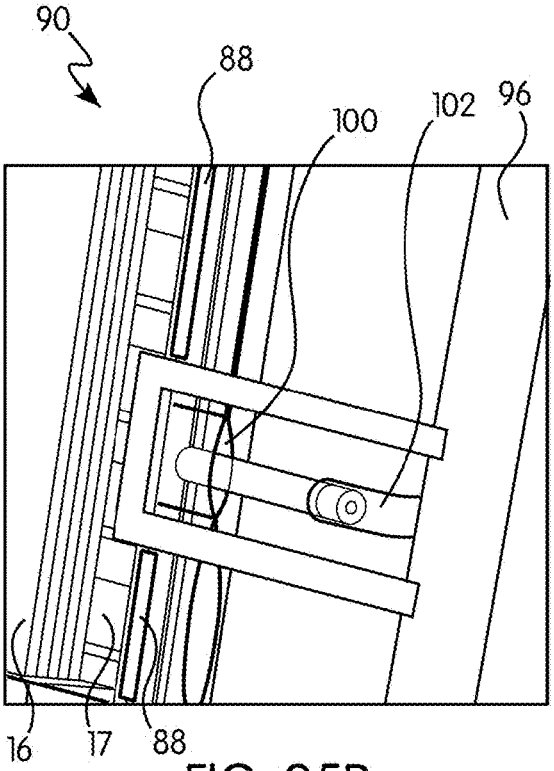
Figure 25C:
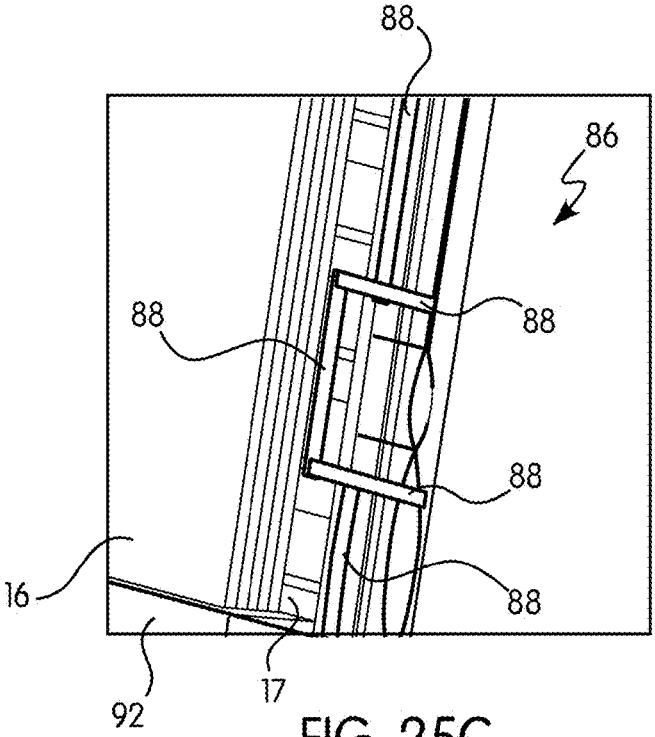

Referring to FIGS. 25A-C, a non-limiting embodiment of the wrapping apparatus 90 for forming a vacuum sealed wrapped system 86 is shown. In this non-limiting embodiment, all sides of the wrap 17 around the pack 16 may be sealed (e.g., using the side sealer 96 and the top sealer 98) except for a gap 100 in the wrap 17. In the embodiment shown in FIG. 25A, the side sealer 96 thermally seals a side of the wrap 17, except for the gap 100, through which air and moisture can enter and escape. As shown in FIG. 25A, a vacuum tube 102 may be positioned in the gap 100 and may be configured to remove the air and/or moisture from between the pack 16 and the wrap 17. The vacuum tube 102 may be used to form a vacuum between the pack 16 the wrap 17. As shown in FIG. 25B, a section of the side sealer 96 may be rotated such that the thermal portion contacts the wrap 17 after the vacuum tube 102 creates the vacuum between the pack 16 and the wrap 17. As can be seen from FIG. 25C, this action fully seals the wrap 17 around the pack 16 so that moisture is prevented from reaching the pack 16, forming the wrapped system 86.

II. Powder Applicator

Figure 26:
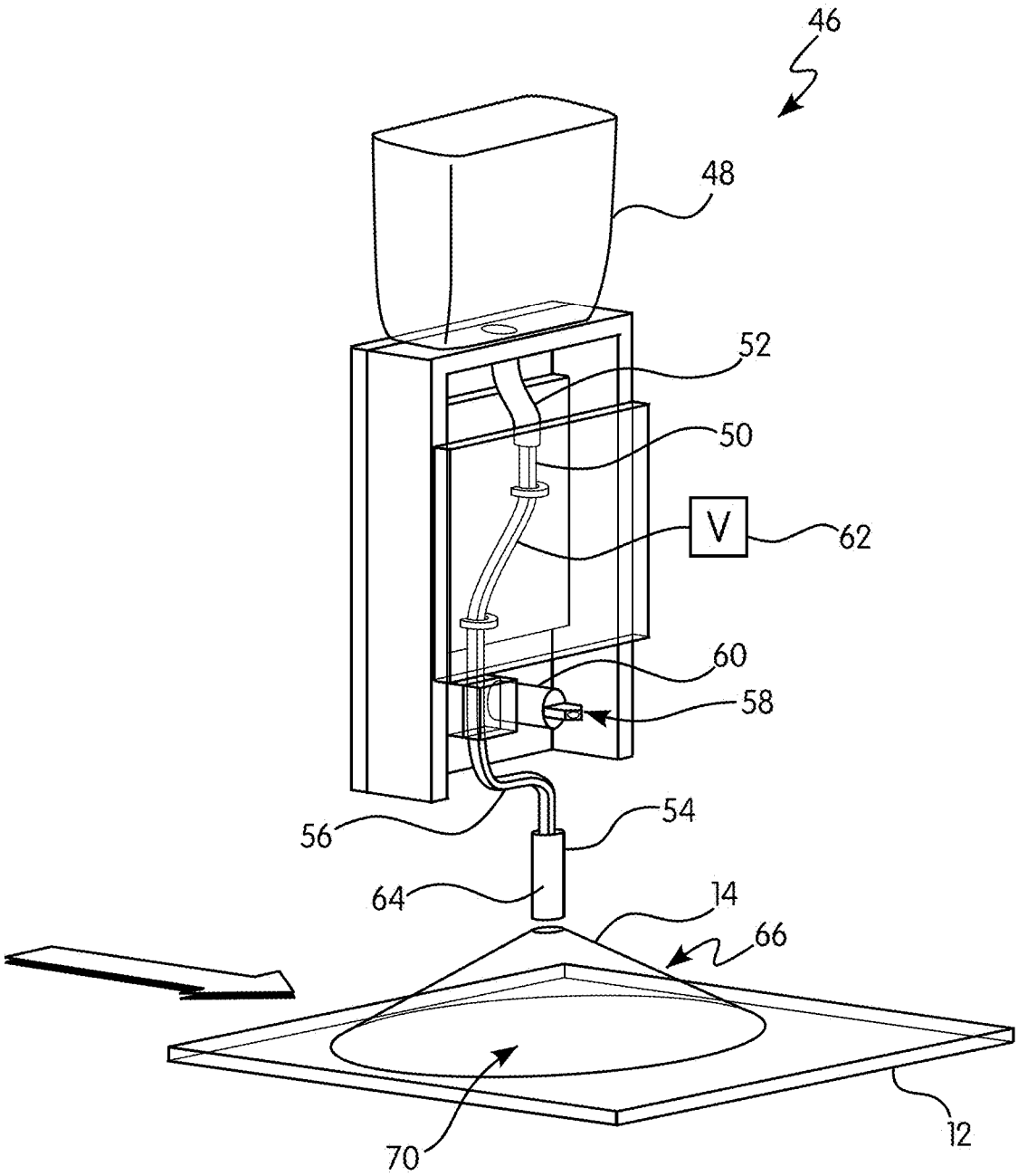
FIG. 26 is a perspective view of a powder applicator according to the present invention.

Referring to FIG. 26, a powder applicator 46 may be used to apply powders, for example the interleaving beads 14 to any substrate 12. The powder applicator 46 may include a container or bucket 48 to hold the interleaving beads 14. The bucket 48 may be a funnel-shaped hopper. A tubing 50 may be in fluid communication with the bucket 48, and the tubing 50 may include a proximal end 52 and a distal end 54. The tubing 50 may be configured to allow interleaving beads 14 to flow therethrough. The tubing 50 may be made of metal, such as copper or other materials. The tubing 50 may run all the way to the bucket 48 or another section of plastic tubing may span therebetween. The powder applicator 46 may further include a vibrator 58 with a motor 60, such as a DC electromotor with off-balance weight. The vibrator 58 may co-act with the tubing 50 so as to vibrate the tubing 50 when the vibrator 58 is activated (e.g., the motor 60 is running). The tubing 50 may include a substantially horizontal portion 56 proximate the distal end 54 of the tubing 50. Substantially horizontal in this situation means perfectly horizontal or at least more horizontal than vertical (e.g., having an angle relative to the horizontal axis that is less than 45° in any direction). The substantially horizontal portion 56 may extend all the way to the distal end 54 of the tubing 50, or another substantially vertical portion of the tubing 50 may be located in between the substantially horizontal portion 56 and the distal end 54 of the tubing 50. When the vibrator 58 is activated, the interleaving beads 14 in the tubing 50 exit the tubing 50. When the vibrator 58 is not activated, the interleaving beads 14 in the tubing 50 do not exit the tubing 50.

With continued reference to FIG. 26, the powder applicator 46 may further include a charge applicator 62. The charge applicator 62 may co-act with the tubing 50 such that, when the charge applicator 62 is activated, it applies a charge to the interleaving beads 14. Applying a charge to the interleaving beads 14 may help the interleaving beads 14 adhere to the substrates 12 after the interleaving beads 14 exit the distal end 54 of the tubing 50. The voltage applied to the interleaving beads 14 can be a high voltage, such as 10,000 Volts. The charge applicator 62 may have the capability of supplying a few hundred volts to 20,000 Volts to the interleaving beads 14.

The powder applicator 46 may further include a plastic tube ending 64 in fluid communication with the distal end 54 of the tubing 50 to improve the bead spatial spread.

With continued reference to FIG. 26, the interleaving beads 14 may exit the powder applicator 46 when the vibrator 58 is activated. The vibrator 58 may induce a low vibration magnitude in the tubing 50, in which case the interleaving beads 14 may fall almost directly from the outlet. In other cases, the vibrator 58 and the tubes 50 may be designed such that the vibrator 58 may excite the natural vibration modes of the tubing 50. In this case, the distal end 54 may move up to a few inches when the natural modes are excited. Thus, the vibrator 58 may cause the interleaving beads 14 to form the bead shower 66 that may be as wide as a few feet. The interleaving beads 14 of the bead shower 66 fall onto the substrate 12 passing beneath the powder applicator 46 at a substrate feed rate. In one example, the vibrator 58 causes the tubing 50 to vibrate in such a way that the bead shower 66 is substantially conical in shape. However, the tubing 50 may be vibrated in such a way to form a bead shower 66 in any desired shape. The powder applicator 46 may be designed to, when the vibrator 58 is activated, substantially uniformly coat the substrate 12 with the interleaving beads 14 over an entire region 70 of the substrate 12 spanned by the bead shower 66. Substantially uniformly in this context means that the interleaving bead coverage applied over any one region of the substrate 12 is within 20%, such as 15%, 10%, 5%, 2%, or 1% of the interleaving bead coverage applied over any other region over the entire region 70 of the substrate spanned by the bead shower 66. The entire region 70 spanned by the bead shower 66 may be the area of the substrate 12 under the powder applicator 46 over which interleaving beads 14 of the bead shower 66 extend. For instance, the entire region 70 spanned by the bead shower 66 in FIG. 26 is a circle-shaped region of the substrate 14 since the bead shower 66 in this example is conical in shape.

The present invention further includes the subject matter of the following clauses.

Clause 1: A shipping system for shipping planar substrates comprising: a plurality of planar substrates stacked to form a pack; and interleaving material comprising substantially spherical beads positioned between the substrates of the pack and configured to carry a load, wherein substantially all of the beads have a diameter within 25% of $D_{max}$, wherein $D_{max}$ is a diameter corresponding to a size of an opening of an upper limit sieve used in the shipping system.

Clause 2: The shipping system of clause 1, wherein substantially all of the beads have a diameter between 1 μm and 1 mm.

Clause 3: The shipping system of clause 1 or 2, wherein substantially all of the beads have a radius at or above $D_{min}$ according to the following formula: $D_{min} \geq D_{max}\mu^2$, wherein $D_{max}$ is a diameter corresponding to a size of an opening of an upper limit sieve used in the shipping system and μ is a friction coefficient between the beads and the substrate.

Clause 4: The shipping system of any of clauses 1-3, wherein substantially all of the beads have a diameter within 10% of $D_{max}$.

Clause 5: The shipping system of any of clauses 1-4, comprising a plurality of packs, each of the packs comprising an exposed face, wherein the shipping system further comprises a spacer positioned between two of the packs, wherein the spacer comprises an area in contact with the exposed faces of the packs.

Clause 6: The shipping system of clause 5, wherein the spacer comprises polystyrene.

Clause 7: The shipping system of clause 5 or 6, wherein the spacer has a continuous thickness in the area in contact with the exposed faces of the packs, and the area covers substantially an entire area of the exposed faces of the packs in contact with the spacer.

Clause 8: The shipping system of any of clauses 5-7, wherein each of the packs and substrates comprise a first region, a second region, and a third region between the first region and second region, and wherein the spacer is in contact with the exposed faces of the first regions and/or second regions of the packs.

Clause 9: The shipping system of clause 8, wherein the first regions and second regions of the packs and substrates range from 1% to 10% of the length, as measured from a first edge and second edge of the packs and substrates, respectively.

Clause 10: The shipping system of clause 8 or 9, wherein the spacer comprises a first raised area in contact with the exposed faces of the first regions of the packs and a second raised area in contact with the exposed faces of the second regions of the packs.

Clause 11: The shipping system of clause 10, wherein the first raised area and second raised area comprise a softer material compared to a material of the spacer.

Clause 12: The shipping system of clause 10 or 11, wherein the spacer comprises a elongated portion running between the first raised area and second raised area, and wherein the elongated portion is not in contact with the exposed faces of the packs.

Clause 13: The shipping system of clause 8, further comprising an A-frame configured to support the packs.

Clause 14: The shipping system of clause 13, wherein the A-frame comprises a strut, the strut in contact with the exposed face of one of the packs.

Clause 15: The shipping system of clause 14, wherein the strut comprises a plurality of raised regions, the raised regions comprising a softer material compared to a material of the strut, wherein the raised regions comprise a first raised region and a second raised region, and wherein the first raised region is in contact with the exposed face of the first region of the pack in contact with the strut and the second raised region is in contact with the exposed face of the second region of the pack in contact with the strut.

Clause 16: The shipping system of clause 8, wherein an interleaving material coverage between two of the substrates of one of the packs is 2 to 20 times greater between the first and/or second regions of the substrates compared to an interleaving material coverage of the interleaving material between the third regions of the substrates.

Clause 17: The shipping system of any of clauses 1-16, wherein each of the packs is wrapped in a sealed plastic wrap.

Clause 18: The shipping system of any of clauses 1-17, wherein the interleaving beads comprise poly(ethyl methacrylate) (PEMA) or poly(methyl methacrylate) (PMMA) beads.

Clause 19: A shipping system for shipping planar substrates comprising: a plurality of planar substrates stacked to form a pack; and interleaving material comprising substantially spherical beads positioned between the substrates of the pack and configured to carry a load, wherein substantially all of the beads have a radius at or above $D_{min}$ according to the following formula: $D_{min} \geq D_{max}\mu^2$, wherein $D_{max}$ is a diameter corresponding to a size of an opening of an upper limit sieve used in the shipping system and $\mu$ is a friction coefficient between the beads and the substrate.

Clause 20: The shipping system of clause 19, wherein substantially all of the beads have a diameter within 25% of $D_{max}$, wherein $D_{max}$ is a diameter corresponding to a size of an opening of an upper limit sieve used in the shipping system.

Clause 21: A spacer for use in a shipping system for shipping planar substrates comprising: an elongated portion having a first end and a second end and a first side and a second side; a flange positioned at the first end of the elongated portion and extending from the first side; and a raised area positioned on the elongated portion.

Clause 22: The spacer of clause 21, wherein the spacer comprises polystyrene.

Clause 23: The spacer of clause 21 or 22, wherein the raised area comprises a softer material compared to the elongated portion.

Clause 24: The spacer of clause 23, wherein the softer material comprises polyethylene or polyurethane.

Clause 25: The spacer of any of clauses 21-24, wherein the raised area is at least ⅛ inch thick.

Clause 26: The spacer of any of clauses 21-25, comprising a plurality of raised areas positioned on the elongated portion.

Clause 27: The spacer of clause 26, wherein the plurality of raised areas comprises a first raised area and a second raised area, wherein the first raised area is positioned on the first side of the first end of the elongated portion and the second raised area is positioned on the first side of the second end of the elongated portion.

Clause 28: The spacer of clause 26, wherein the plurality of raised areas comprises a first raised area and a second raised area, wherein the first raised area is positioned on the first side of the first end of the elongated portion and the second raised area is positioned on the second side of the first end of the elongated portion.

Clause 29: The spacer of clause 28, wherein the second raised area extends over a corner of the first end of the elongated portion.

Clause 30: The spacer of any of clauses 21-29, wherein the second side of the elongated portion does not comprise the raised area.

Clause 31: The spacer of any of clauses 21-30, further comprising tape covering the raised area.

Clause 32: The spacer of any of clauses 21-31, wherein the first end of the elongated portion comprises a first width and the second end of the elongated portion comprises a second width, wherein the first width is larger than the second width.

Clause 33: The spacer of any of clauses 21-32, wherein the first end and the second end of the elongated portion comprise a first width, and a section of the elongated portion between the first end and the second end comprises a second width, wherein the first width is larger than the second width.

Clause 34: The spacer of any of clauses 21-33, wherein the spacer is positioned between a plurality of packs in the shipping system, each pack comprising a plurality of planar substrates.

Clause 35: The spacer of clause 34, wherein the flange is positioned over a top of a pack and the elongated portion is positioned over an exposed face of the pack.

Clause 36: The spacer of clause 35, wherein the raised area is in contact with the exposed face of the pack.

Clause 37: The spacer of clause 36, wherein the raised area is in contact with an end of the exposed face of the pack.

Clause 38: The spacer of clause 37, wherein the end of the exposed face of the pack comprises a region at the end of the pack having a length of 1% to 10% of the length of the pack, as measured from an edge of the pack.

Clause 39: The spacer of clause 34, wherein a plurality of the spacers are positioned between the plurality of packs.

Clause 40: The spacer of clause 34, wherein a single spacer is positioned between the plurality of packs, the single spacer having a width substantially the same as a width of the plurality of packs.

Clause 41: A wrapped system for shipping planar substrates comprising: a plurality of planar substrates stacked to form a pack; and plastic wrap positioned around the pack, wherein the plastic wrap is sealed around the pack.

Clause 42: The wrapped system of clause 41, wherein the plastic wrap is sealed such that moisture is prevented from reaching the pack.

Clause 43: The wrapped system of clause 41 or 42, wherein the seal is formed by thermal sealing.

Clause 44: The wrapped system of any of clauses 41-43, wherein air is removed from the wrapped system prior to completely sealing the plastic wrap.

Clause 45: The wrapped system of clause 44, wherein removal of the air creates a vacuum in the wrapped system.

Clause 46: The wrapped system of any of clauses 41-45, wherein the plastic wrap comprises polyethylene.

Clause 47: The wrapped system of any of clauses 41-46, wherein the plastic wrap is corrugated.

Clause 48: The wrapped system of any of clauses 41-47, wherein the plastic wrap comprises a single sheet.

Clause 49: The wrapped system of any of clauses 41-48, wherein the wrapped system is free of openings in the plastic wrap.

Clause 50: The wrapped system of any of clauses 41-49, wherein the planar substrates comprise glass.

Clause 51: A method of wrapping a system for shipping planar substrates comprising: providing a plurality of planar substrates stacked to form a pack; positioning plastic wrap to completely surround the pack; and sealing at least a portion of the plastic wrap.

Clause 52: The method of clause 51, wherein the plastic wrap is sealed such that moisture is prevented from reaching the pack.

Clause 53: The method of clause 51 or 52, wherein the sealing step comprises thermally sealing the plastic wrap.

Clause 54: The method of any of clauses 51-53, further comprising removing air from the system before completely sealing the plastic wrap.

Clause 55: The method of any of clauses 51-54, wherein the plastic wrap comprises polyethylene.

Clause 56: The method of any of clauses 51-55, wherein the plastic wrap comprises a single sheet.

Clause 57: The method of any of clauses 51-56, wherein the system is free of openings in the plastic wrap.

Clause 58: The method of any of clauses 51-57, wherein the plastic wrap is corrugated.

Clause 59: The method of clause 54, wherein removing air from the system creates a vacuum in the system.

Clause 60: The method of any of clauses 51-59, wherein the planar substrates comprise glass.

Clause 61: A powder applicator comprising: a bucket configured to hold powder; a tubing comprising a proximal end and a distal end, the tubing in fluid communication with the bucket and configured to allow powder to flow therethrough; and a vibrator comprising a motor, wherein the vibrator co-acts with the tubing so as to vibrate the tubing when the vibrator is activated, wherein the tubing comprises a substantially horizontal portion proximate the distal end of the tubing such that, when the vibrator is not activated, the powder in the tubing does not exit the distal end of the tubing and, when the vibrator is activated, the powder in the tubing exits the distal end of the tubing.

Clause 62: The applicator of clause 61, further comprising a charge applicator, wherein the charge applicator co-acts with the tubing such that, when activated, the charge applicator applies a charge to the powder flowing through the tubing.

Clause 63: The applicator of clause 61 or 62, further comprising a plastic tube ending in fluid communication with the distal end of the tubing.

Clause 64: The applicator of any of clauses 61-63, wherein, when the vibrator is activated, the powder in the tubing exits the distal end of the tubing creating a powder shower.

Clause 65: The applicator of clause 64, wherein the powder shower is substantially conical in shape.

Clause 66: The applicator of clause 64 or 65, wherein, when the vibrator is activated, the powder substantially uniformly coats a substrate passing under the powder applicator over an entire region of the substrate spanned by the powder shower.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A wrapped system for shipping planar substrates comprising:

a plurality of planar substrates stacked to form a pack, said pack including edges; and plastic wrap positioned around the pack, wherein the plastic wrap is sealed around the pack, wherein the plastic wrap is loosely sealed around the pack at a location spaced a predetermined distance from the edges of the pack and with little overlap of the plastic wrap to minimize pressure points induced by the plastic wrap on the pack and to reduce concentrated pressure at the edges of the pack, and wherein air is removed from the wrapped system prior to completely sealing the plastic wrap, such that the completely sealed plastic wrap remains loosely sealed around the pack so as to minimize pressure points induced by the plastic wrap on the pack and to reduce concentrated pressure at the edges of the pack.

2. The wrapped system of claim 1, wherein the plastic wrap is sealed such that moisture is prevented from reaching the pack.

3. The wrapped system of claim 1, wherein the plastic wrap is sealed by thermal sealing.

4. The wrapped system of claim 1, wherein removal of the air creates a vacuum in the wrapped system.

5. The wrapped system of claim 1, wherein the plastic wrap comprises polyethylene.

6. The wrapped system of claim 1, wherein the plastic wrap is corrugated.

7. The wrapped system of claim 1, wherein the plastic wrap comprises a single sheet.

8. The wrapped system of claim 1, wherein the wrapped system is free of openings in the plastic wrap such that gas and/or liquid cannot penetrate the plastic wrap.

9. The wrapped system of claim 1, wherein the planar substrates comprise glass.

10. A wrapped system for shipping planar substrates comprising:

a plurality of planar substrates stacked to form a pack, said pack including edges; and plastic wrap positioned around the pack, wherein the plastic wrap is sealed around the pack, wherein the plastic wrap is loosely sealed around the pack with little overlap of the plastic wrap to minimize pressure points induced by the plastic wrap on the pack and to reduce concentrated pressure at the edges of the pack, and wherein air is removed from the wrapped system prior to completely sealing the plastic wrap, wherein a plurality of wrapped packs are provided and wherein a spacer is provided between exposed faces of at least two of the wrapped packs, said spacer comprising a continuous sheet in contact with and covering substantially an entire area of the exposed faces of the at least two wrapped packs, said continuous sheet including a horizontally extending portion that is perpendicular with respect to the continuous sheet in contact with the exposed faces of the packs, wherein the horizontally extending portion is configured for fitting about at least one of the edges of the pack.

11. The wrapped system of claim 10, wherein the plastic wrap is sealed such that moisture is prevented from reaching the pack.

12. The wrapped system of claim 10, wherein the plastic wrap is sealed by thermal sealing.

13. The wrapped system of claim 10, wherein removal of the air creates a vacuum in the wrapped system.

14. The wrapped system of claim 10, wherein the plastic wrap comprises polyethylene.

15. The wrapped system of claim 10, wherein the plastic wrap is corrugated.

16. The wrapped system of claim 10, wherein the plastic wrap comprises a single sheet.

17. The wrapped system of claim 10, wherein the wrapped system is free of openings in the plastic wrap such that gas and/or liquid cannot penetrate the plastic wrap.

18. The wrapped system of claim 10, wherein the planar substrates comprise glass.

19. A wrapped system for shipping planar substrates comprising:

a plurality of planar substrates stacked to form a pack, said pack including edges; and plastic wrap positioned around the pack, wherein the plastic wrap is sealed around the pack, wherein the plastic wrap is loosely sealed around the pack with little overlap of the plastic wrap to minimize pressure points induced by the plastic wrap on the pack and to reduce concentrated pressure at the edges of the pack, and wherein air is removed from the wrapped system prior to completely sealing the plastic wrap, wherein an amount of tension and an amount of overlap of the plastic wrap is determined according to the following formula:

$$F/L=T/(w*(1-\alpha)),$$

in which F is the force applied at the edge of the pack, L is the length of the edge of the pack, T is the tension in the wrap, w is the width of the wrap, and $\alpha$ is the percentage of overlap.

20. A wrapped system for shipping planar substrates comprising:

a plurality of planar substrates stacked to form a pack, said pack including edges; and plastic wrap positioned around the pack, wherein the plastic wrap is sealed around the pack, wherein the plastic wrap is loosely sealed around the pack with little overlap of the plastic wrap to minimize pressure points induced by the plastic wrap on the pack and to reduce concentrated pressure at the edges of the pack, and wherein air is removed from the wrapped system prior to completely sealing the plastic wrap, wherein interleaving material is located between the plurality of planar substrates and wherein more interleaving material is located at the edge of the pack than is located in a center of the pack to prevent transit damage to the pack caused by a force applied from the plastic wrap.

* * * * *